US010942488B2

(12) United States Patent
Takahashi et al.

(10) Patent No.: US 10,942,488 B2
(45) Date of Patent: Mar. 9, 2021

(54) IMAGE FORMING APPARATUS WITH AIR BLOWING PART CONTROLLING AIR BLOW RATE IN ACCORDANCE WITH IMAGE FORMING STATE

(71) Applicant: Oki Data Corporation, Tokyo (JP)

(72) Inventors: Keita Takahashi, Tokyo (JP); Takashi Saito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/795,811

(22) Filed: Feb. 20, 2020

(65) Prior Publication Data

US 2020/0310347 A1 Oct. 1, 2020

(30) Foreign Application Priority Data

Mar. 25, 2019 (JP) ..... JP2019-056178
Sep. 27, 2019 (JP) ..... JP2019-177375

(51) Int. Cl.

| | |
|---|---|
| ***G03G 21/00*** | (2006.01) |
| ***G03G 15/00*** | (2006.01) |
| ***G03G 21/20*** | (2006.01) |
| ***G03G 15/20*** | (2006.01) |

(52) U.S. Cl.
CPC ..... *G03G 21/206* (2013.01); *G03G 15/2017* (2013.01); *G03G 2221/1645* (2013.01)

(58) Field of Classification Search
CPC ..... G03G 15/0178; G03G 21/206; G03G 2215/0193; G03G 2221/1645; G03G 15/2017
See application file for complete search history.

(56) References Cited

U.S. PATENT DOCUMENTS

| | | | | |
|---|---|---|---|---|
| 2014/0140719 | A1* | 5/2014 | Suzuki | G03G 21/206 399/92 |
| 2017/0285571 | A1* | 10/2017 | Takahashi | G03G 21/206 |
| 2017/0343961 | A1* | 11/2017 | Shimohora | G03G 21/206 |
| 2018/0150025 | A1* | 5/2018 | Egi | G03G 21/206 |
| 2018/0314197 | A1* | 11/2018 | Konishi | G03G 21/206 |

FOREIGN PATENT DOCUMENTS

| | | |
|---|---|---|
| JP | 2007-122044 A | 5/2007 |
| JP | 2012-150313 A | 8/2012 |

* cited by examiner

*Primary Examiner* — Sophia S Chen
(74) *Attorney, Agent, or Firm* — Muncy, Geissler, Olds & Lowe, P.C.

(57) ABSTRACT

An image forming apparatus includes an image forming unit that forms an image when a working state of the image forming unit is an image forming state and does not form an image when the working state is a non-image forming state, an air blowing part that blows air toward the image forming unit, an air flow rate changing part that changes a flow rate of the air blown toward the image forming unit from the air blowing part, and a switching part that performs a switching to switch the working state of the image forming unit between the image forming state and a non-image forming state, wherein the air flow rate changing part changes the air flow rate of the air blowing part in mechanical correspondence with the switching between the image forming state and the non-image forming state of the image forming unit by the switching part.

18 Claims, 35 Drawing Sheets

IMAGE FORMING APPARATUS WITH AIR BLOWING PART CONTROLLING AIR BLOW RATE IN ACCORDANCE WITH IMAGE FORMING STATE

TECHNICAL FIELD

This invention relates to an image forming apparatus.

BACKGROUND

Among image forming apparatuses, there is one provided with an air blowing device that blows air to image forming units in order to suppress a temperature rise inside the image forming units (e.g., Patent Document 1).

In addition, proposed is an image forming apparatus that is provided with an air sucking/exhaust device to blow air to an exposure part and a fuser part and is configured so that their air flow rates are individually adjustable.

RELATED ART

[Patent Document 1] JP Laid-Open Patent Application Publication 2007-122044 (e.g., see Paragraphs 0021-0022).

[Patent Document 2] JP Laid-Open Patent Application Publication 2012-150313 (e.g., see Paragraphs 0064-0073).

However, it is demanded that the image forming units be more efficiently cooled.

This invention has been made in order to solve the above-mentioned problem, and its objective is to offer an image forming apparatus that can cool its image forming units more efficiently.

SUMMARY

An image forming apparatus, disclosed in the application, includes an image forming unit that forms an image when a working state of the image forming unit is an image forming state and does not form an image when the working state is a non-image forming state, an air blowing part that blows air toward the image forming unit, an air flow rate changing part that changes a flow rate of the air, which is blown toward the image forming unit from the air blowing part, and a switching part that performs a switching to switch the working state of the image forming unit between the image forming state and a non-image forming state, wherein the air flow rate changing part changes the air flow rate of the air blowing part in mechanical correspondence with the switching between the image forming state and the non-image forming state of the image forming unit by the switching part.

According to one embodiment of this invention, the flow rates of air blown to the image forming units are changed interlocking mechanically with switching between an image forming state and a non-image forming state of the image forming units by a switching part, therefore the image forming units can be more efficiently cooled.

BRIEF DESCRIPTION OF THE DRAWINGS

FIG. 13A illustrates reference positions of these sliders. FIG. 13B illustrates cut-off positions of these sliders.

DETAILED DESCRIPTIONS OF PREFERRED EMBODIMENT(S)

Below, embodiments of this invention are explained in detail referring to drawings. Note that this invention is not limited by these embodiments.

First Embodiment

<Configuration of Image Forming Apparatus>

Figure 1:
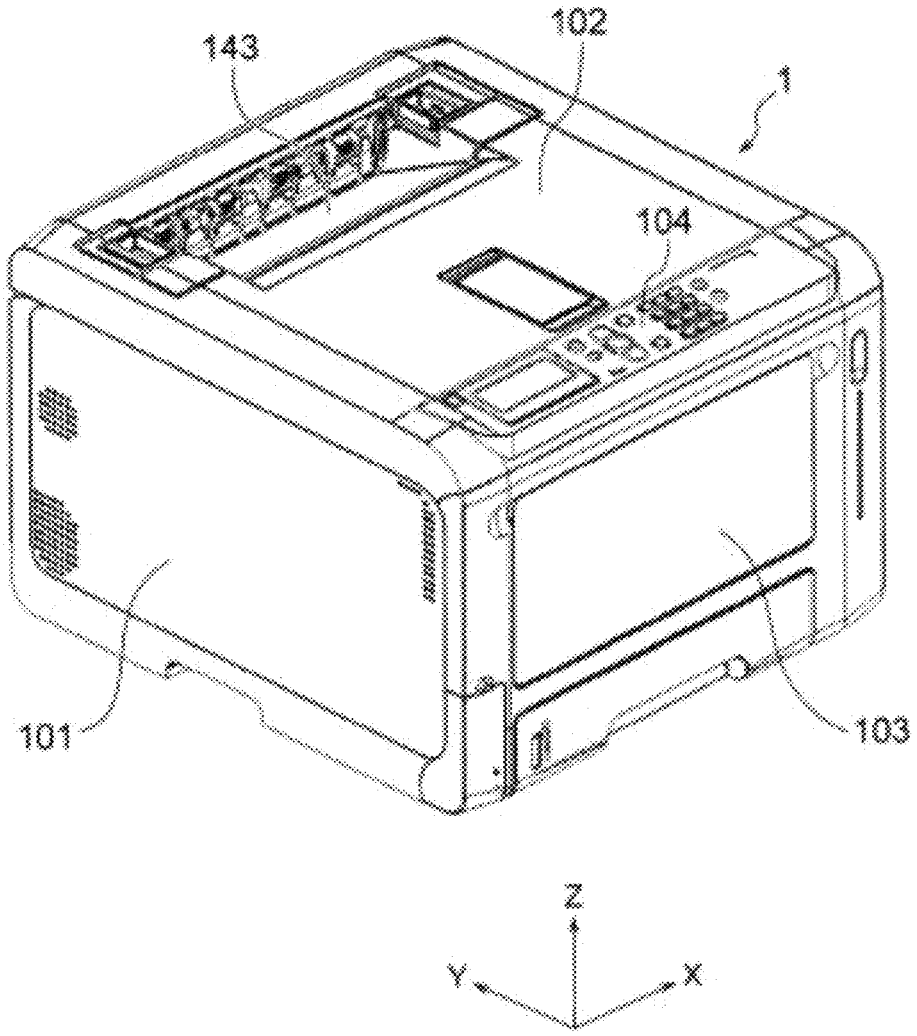
FIG. 1 is a perspective view showing an image forming apparatus of the first embodiment.
Figure 2:
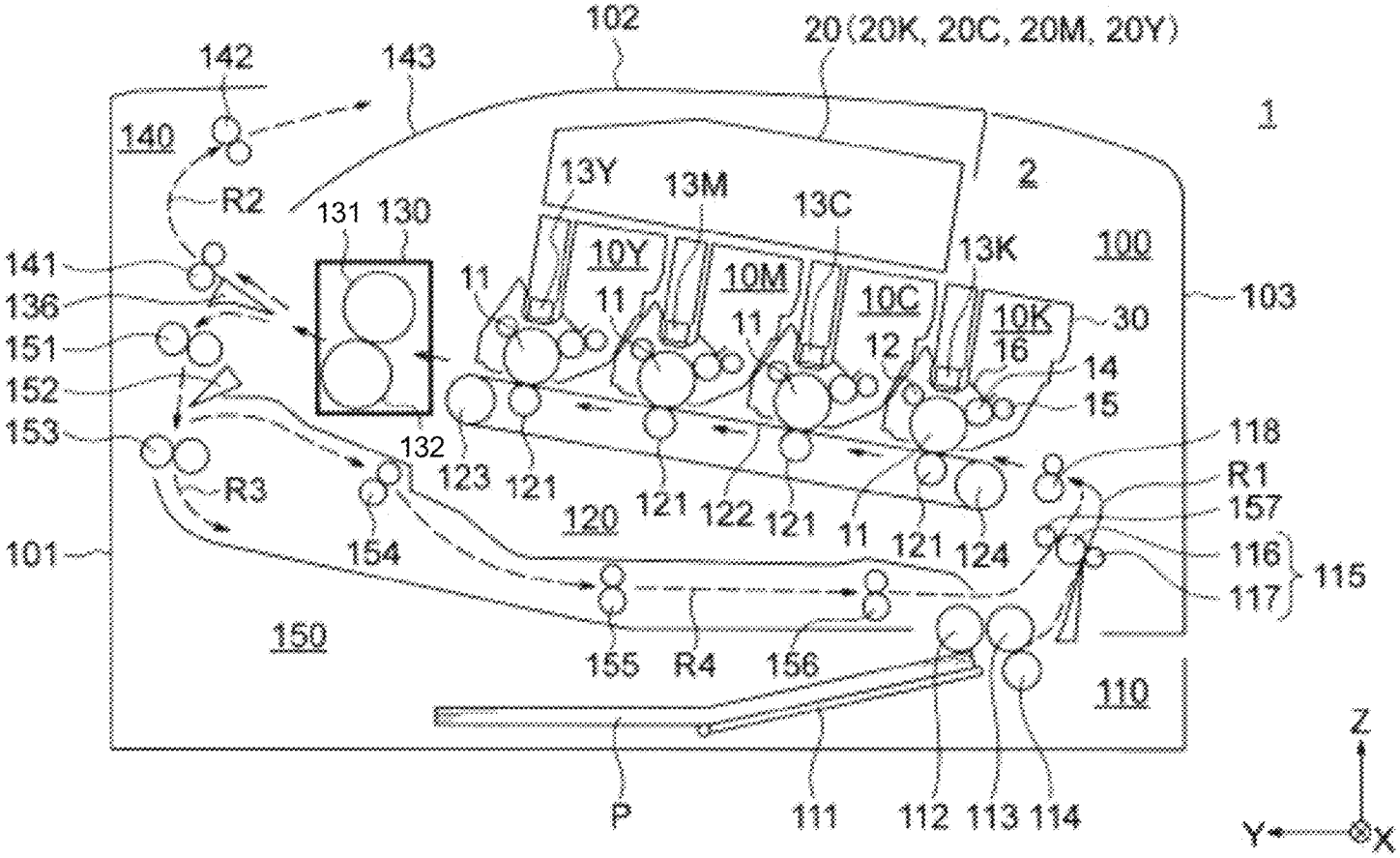
FIG. 2 is a diagram showing the internal configuration of the image forming apparatus of the first embodiment.

FIG. 1 is a perspective view showing the external appearance of an image forming apparatus 1 of the first embodiment. FIG. 2 is a diagram showing the internal configuration of the image forming apparatus 1. The image forming apparatus 1 is a printer that forms color images using an electrophotographic method.

As shown in FIG. 2, the image forming apparatus 1 is provided with a medium supply part 110 that supplies a medium P such as a printing sheet, an image forming part 100 that forms toner images (developer images), a transfer unit 120 that transfers the toner images formed in the image forming part 100 to the medium P, a fuser device 130 that fuses the toner images to the medium P, a medium ejection part 140 that ejects the medium P, and a chassis 101 that accommodates them.

The medium supply part 110 has a sheet feeding tray 111 that accommodates the medium P, a pickup roller 112 disposed so as to contact the medium P accommodated in the sheet feeding tray 111, a feed roller 113 disposed adjacent to the pickup roller 112, and a retard roller 114 disposed opposing the feed roller 113.

The sheet feeding tray 111 accommodates the medium P such as printing sheets in a stacked state. The pickup roller 112 rotates in contact with the medium P in the sheet feeding tray 111 to feed out the medium P from the sheet feeding tray 111. The feed roller 113 forwards the medium P fed out by the pickup roller 112 to a carrying route. The retard roller 114 rotates in the opposite direction of the forwarding direction by the feed roller 113 to prevent multi-feed by giving a carrying resistance to the medium P.

The medium supply part 110 also has carrying rollers 115 and 118 along the carrying route of the medium P. The carrying roller 115 comprises a registration roller 116 and a pinch roller 117 in contact with it, and starts rotating at a prescribed timing after the leading edge of the medium P has contacted the nip part of the both rollers, thereby correcting skew of the medium P and carrying it. The carrying roller 118 carries the medium P from the carrying roller 115 to the image forming part 100.

The image forming part 100 has four process units 10K, 10C, 10M, and 10Y as image forming units that form black, cyan, magenta, and yellow toner images, respectively. Disposed so as to oppose the photosensitive drums 11 (mentioned below) of the process units 10K, 10C, 10M, and 10Y are print heads 13K, 13C, 13M, and 13Y as exposure devices, respectively.

The process units 10K, 10C, 10M, and 10Y are arranged in this order along the carrying direction of the medium P (here, from the right to the left in the figure). The process units 10K, 10C, 10M, and 10Y are called "process units 10" when no particular distinction is necessary. Also, the print heads 13K, 13C, 13M, and 13Y are called "print heads 13" when no particular distinction is necessary.

The process unit 10 has a photosensitive drum 11 as an image carrier that carries a toner image, a charging roller 12 as a charging member, a development roller 14 as a developer carrier, a supply roller 15 as a supply member, a development blade 16 as a developer regulating member, and a unit frame 30 that accommodates them.

Figure 18:
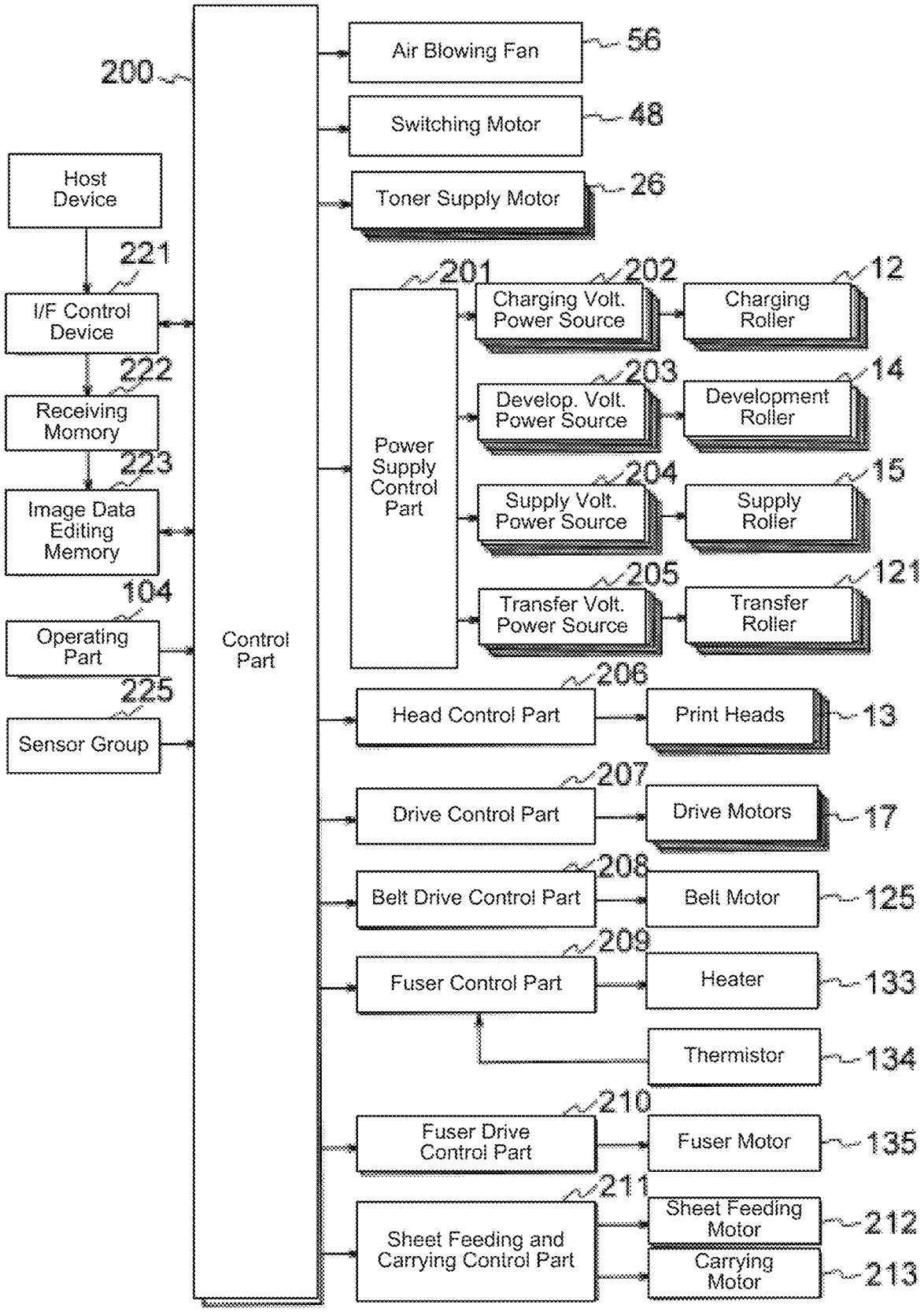
FIG. 18 is a block diagram showing the control system of the image forming apparatus of the first embodiment.

The photosensitive drum 11 is a cylindrical member having a photosensitive layer (a charge generation layer and a charge transportation layer) installed on the surface of a conductive base body, and rotates clockwise in the figure by a drive motor 17 (FIG. 18).

The charging roller 12 is disposed so as to contact the surface of the photosensitive drum 11, and rotates following the rotation of the photosensitive drum 11. To the charging roller 12, a charging voltage is applied by a charging voltage power source 202 (FIG. 18), uniformly charging the surface of the photosensitive drum 11. On the uniformly-charged surface of the photosensitive drum 11, an electrostatic latent image is formed by light irradiation by the print head 13.

The development roller 14 is disposed so as to contact the surface of the photosensitive drum 11, and rotates in the opposite direction (anticlockwise in the figure) of the photosensitive drum 11. To the development roller 14, a development voltage is applied by a development voltage power source 203 (FIG. 18) to have toner adhere to the electrostatic latent image formed on the surface of the photosensitive drum 11, forming a toner image.

The supply roller 15 is disposed so as to contact or oppose the surface of the development roller 14, and rotates in the same direction as the development roller 14. To the supply roller 15, a supply voltage is applied by a supply voltage power source 204 (FIG. 18) to supply toner to the development roller 14.

The development blade 16 is a metallic blade that is long in the axial direction of the development roller 14, and is disposed so as to be pressed against the surface of the development roller 14. The development blade 16 regulates the thickness of the toner layer formed on the surface of the development roller 14.

In the process unit 10, part including the development roller 14, the supply roller 15, and the development blade 16, that is part contributing to the development of the electrostatic latent image, constitutes a development unit.

Installed above the process units 10K, 10C, 10M, and 10Y are toner cartridges 20K, 20C, 20M, and 20Y as developer accommodation parts that supply toners to the process units 10K, 10C, 10M, and 10Y. The toner cartridges 20K, 20C, 20M, and 20Y are detachably attached to a top cover 102 mentioned below.

The toner cartridges 20K, 20C, 20M, and 20Y accommodate black, cyan, magenta, and yellow toners, respectively. The toner cartridges 20K, 20C, 20M, and 20Y are called "toner cartridges 20" when no particular distinction is necessary.

The print head 13 has, for example, a light emitting element array where light emitting elements such as LEDs (Light Emitting Diodes) are arranged, and a lens array that collects the emitted light rays from the light emitting elements to the surface of the photosensitive drum 11. The print head 13 is driven by a head control part 206 (FIG. 18) to expose the surface of the photosensitive drum 11 with light, forming an electrostatic latent image.

The transfer unit 120 has a transfer belt 122 in an endless shape as a transfer body, a drive roller 123 and an idle roller 124 over which the transfer belt 122 is stretched, and transfer rollers 121 disposed opposing the photosensitive drums 11 of the process units 10K, 10C, 10M, and 10Y through the transfer belt 122.

The transfer belt 122 travels adsorb-holding the medium P on its surface by an electrostatic force. The drive roller 123 rotates by a belt motor 125 (FIG. 18) to have the transfer belt 122 travel. The idle roller 124 gives a tension to the transfer belt 122. To each of the transfer rollers 121, a transfer voltage is applied by a transfer voltage power source 205 (FIG. 18) to transfer the toner image on each of the photosensitive drums 11 to the medium P.

The fuser device 130 is disposed in the downstream side of the image forming part 100 in the carrying direction of the medium P. The fuser device 130 has, for example, a fuser roller 131, and a pressure application roller 132 pressed by this fuser roller 131. The fuser roller 131 contains a heater 133 (FIG. 18) as a heat source, and rotates by a fuser motor 135 (FIG. 18). The fuser roller 131 and the pressure application roller 132 apply heat and a pressure to the toner image transferred to the medium P, fusing it to the medium P.

The medium ejection part 140 is disposed in the downstream side of the fuser device 130 in the carrying direction of the medium P, and is provided with ejection rollers 141 and 142 that are two pairs of rollers. The ejection rollers 141 and 142 carry the medium P forwarded from the fuser device 130 along an ejection carrying route (R2), and eject it to the outside of the image forming apparatus 1. Installed on the top of the image forming apparatus 1 is a stacker part 143 that stacks the media ejected by the ejection rollers 141 and 142.

The image forming apparatus 1 is provided with a recarrying mechanism 150 that reverses the medium P having a toner image fused to its surface and carries it to the above-mentioned carrying roller 115 for double-side printing. Also, installed in the downstream side of the fuser device 130 is a switching guide 136 that guides the medium P forwarded from the fuser device 130 to the medium ejection part 140 or the recarrying mechanism 150.

The recarrying mechanism 150 has carrying rollers 151 and 153 and a switching guide 152 that tentatively send the medium P into a retreat route R3 and switch its front and back, and carrying rollers 154, 155, and 156 that carry the medium P along a return carrying route R4. The return carrying route R4 merges into the upstream side of the carrying roller 118 in a carrying route R1. Installed in the vicinity of the exit of the return carrying route R4 is a pinch roller 157 that contacts the registration roller 116 from the opposite side of the pinch roller 117.

The medium P carried through the carrying route R4 by the carrying rollers 154, 155, and 156 is carried to the upstream side of the carrying roller 118 in the carrying route R1 by a roller pair consisting of the registration roller 116 and the pinch roller 157. Note that if the image forming apparatus 1 has no double-side printing function, the recarrying mechanism 150 is unnecessary.

The image forming apparatus 1 also has an openable top cover 102 attached to the top of the chassis 101, and an openable front cover 103 attached to the front of the chassis 101. Installed on the top cover 102 is an operation part 104 (FIG. 1) such as an operation panel. Also, the above-mentioned toner cartridges 20K, 20C, 20M, and 20Y are attached to the top cover 102.

In FIG. 2, the direction of the rotation axes of the photosensitive drums 11 is denoted as X direction. The X direction is the width direction of the medium P. The direction of the axes of the rollers of the units mentioned above is parallel to the X direction. The depth direction of the image forming apparatus 1 (left-right direction in FIG. 2) that is perpendicular to the X direction is denoted as Y direction. The XY plane is the horizontal plane here. Also, the direction perpendicular to the XY plane, that is the vertical direction here, is denoted as Z direction. Also, regarding the Y direction, the front cover 103 side is denoted as −Y direction, and its opposite side as +Y direction.

In FIG. 2, the process units 10K, 10C, 10M, and 10Y are arranged in a direction inclined relative to the Y direction. Below, the arrangement direction of the process units 10K, 10C, 10M, and 10Y is called unit array direction (approximate Y direction). Note that the unit array direction does not need to be inclined relative to the Y direction but can be parallel to the Y direction.

<Toner Carriage from Toner Cartridge to Process Unit>

Figure 3:
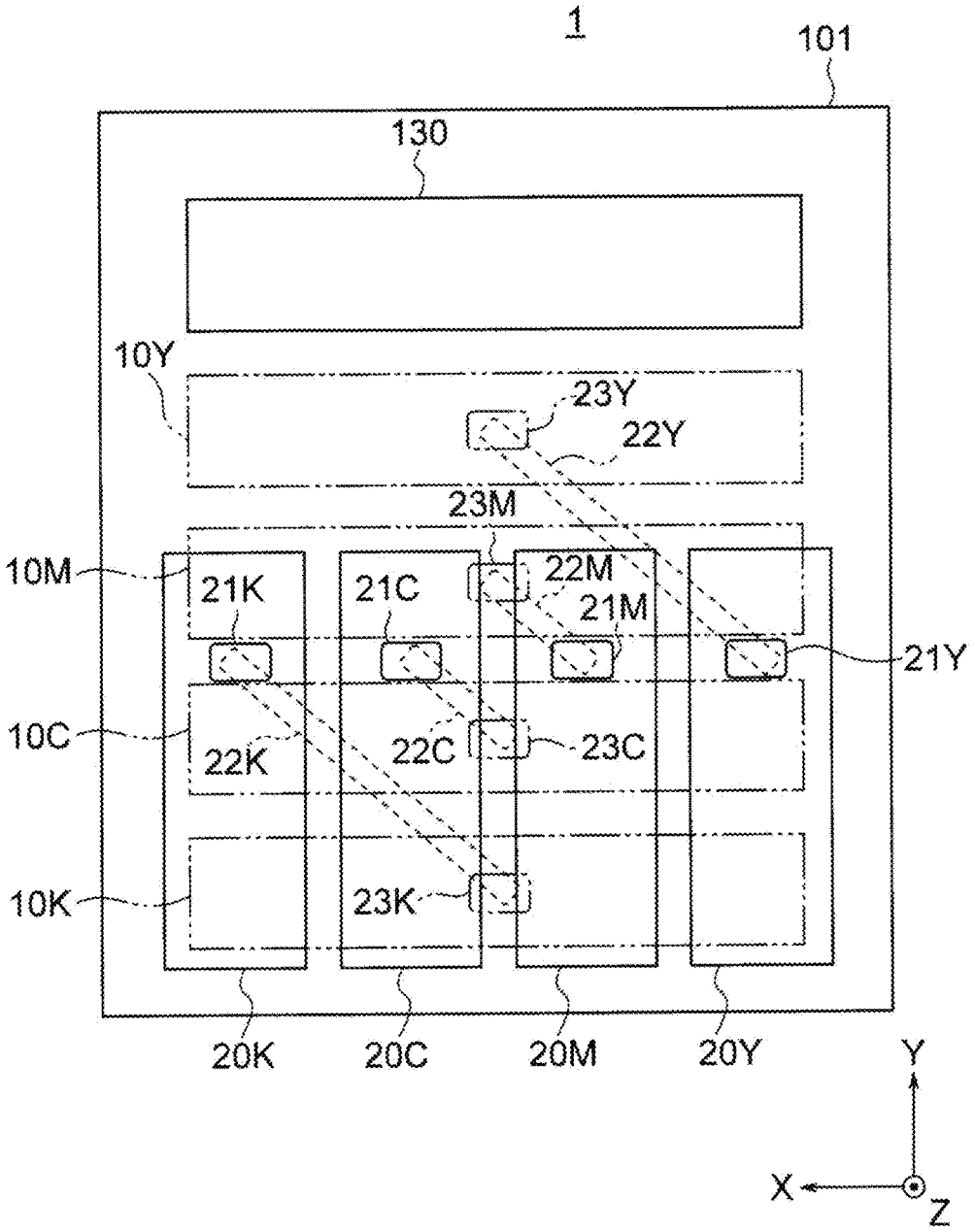
FIG. 3 is a diagram showing the dispositions of process units and toner cartridges of the first embodiment.

FIG. 3 is a schematic diagram showing the positional relation between the process units 10K, 10C, 10M, and 10Y, and the toner cartridges 20K, 20C, 20M, and 20Y.

The process units 10K, 10C, 10M, and 10Y all have a shape elongated in the X direction, and are arranged in a row along the above-mentioned unit array direction (approximate Y direction). On the other hand, the toner cartridges 20K, 20C, 20M, and 20Y all have a shape elongated in the unit array direction, and are arranged in the X direction.

Installed between the toner cartridges 20K, 20C, 20M, and 20Y, and the process units 10K, 10C, 10M, and 10Y are toner ducts 22K, 22C, 22M, and 22Y that are toner carrying routes, respectively.

The toner ducts 22K, 22C, 22M, and 22Y have link parts 21K, 21C, 21M, and 21Y linked to the toner cartridges 20K, 20C, 20M, and 20Y, respectively, and connecting parts 23K, 23C, 23M, and 23Y connected to the process units 10K, 10C, 10M, and 10Y, respectively.

In this example, the link parts 21K, 21C, 21M, and 21Y are disposed in the same Y direction position. Also, the connecting parts 23K, 23C, 23M, and 23Y are disposed in the same X direction position. Note that this invention is not limited to such dispositions.

These toner cartridges 20K, 20C, 20M, and 20Y, and toner ducts 22K, 22C, 22M, and 22Y constitute a toner supply unit 2. The toner supply unit 2 is attached to the top cover 102.

The toner ducts 22K, 22C, 22M, and 22Y are called "toner ducts 22" when no particular distinction is necessary. The link parts 21K, 21C, 21M, and 21Y are called "link parts 21" when no particular distinction is necessary. The connecting parts 23K, 23C, 23M, and 23Y are called "connecting parts 23" when no particular distinction is necessary.

Figure 4A:
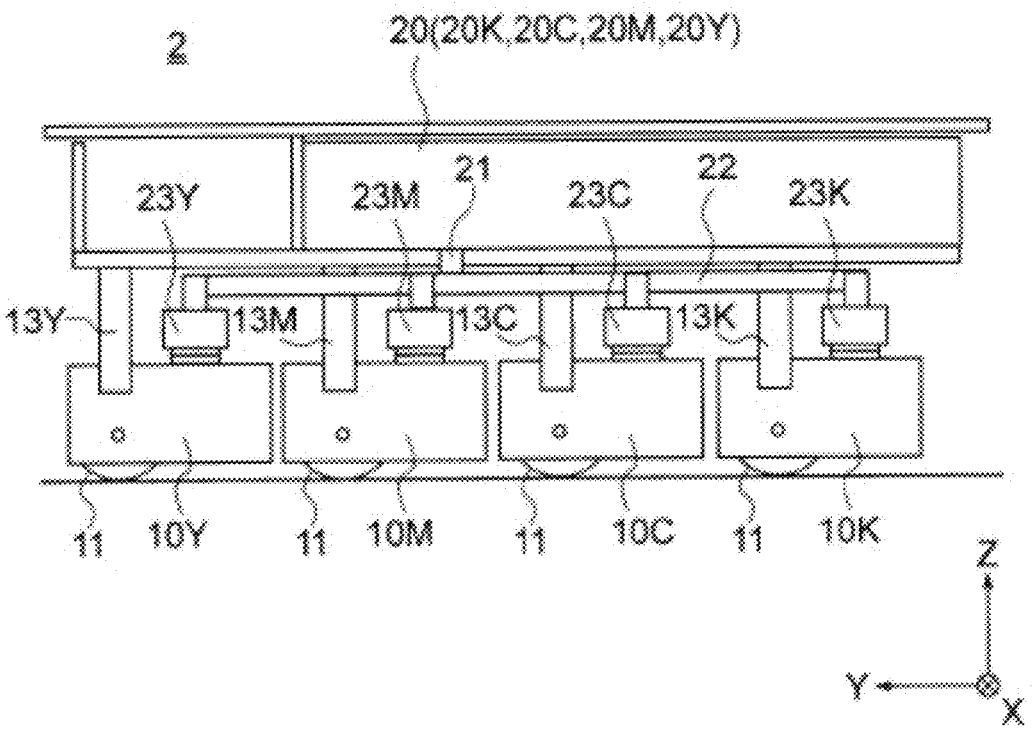
FIG. 4A is a diagram showing the positional relation of the process units, the toner cartridges, and toner ducts.

FIG. 4A is a diagram showing the positional relation of the toner supply unit 2 and the process units 10K, 10C, 10M, and 10Y in the YZ plane. Although the toner ducts 22 are shown as if they were one piece in FIG. 4A, four pieces of toner ducts 22K, 22C, 22M, and 22Y are actually installed as shown in FIG. 3.

Toner accommodated in the toner cartridge 20 is supplied by falling down into the toner duct 22 through the link part 21. Installed inside the toner duct 22 is a carrying spiral 25 (FIG. 4B) as a carrying member for carrying toner. The carrying spiral 25 carries toner along the toner duct 22 from the link part 21 to the connecting part 23. Toner carried inside the toner duct 22 to the connecting part 23 is supplied by falling down to the process unit 10.

Figure 4B:
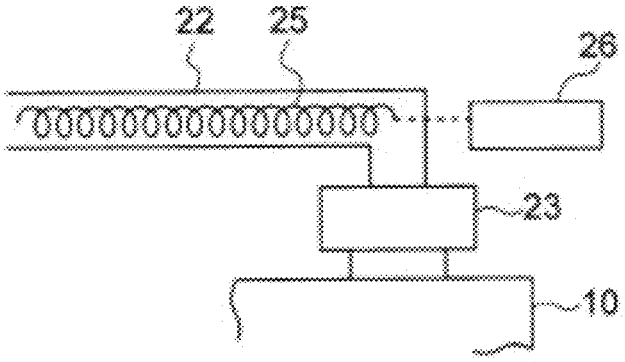
FIG. 4B is a diagram showing a carrying spiral inside the toner ducts of the first embodiment.

FIG. 4B is a diagram showing the carrying spiral 25 inside the toner duct 22. The carrying spiral 25 is disposed over almost the entire range in the longitudinal direction of the toner duct 22, and rotates centering on its rotation axis in the longitudinal direction of the toner duct 22. The carrying spiral 25 is driven by a toner supply motor 26. The toner supply motor 26 is installed individually for each carrying spiral 25 here. Alternatively, the drive force of a shared toner supply motor 26 can be transmitted to the individual carrying spirals 25 through clutches.

Figure 5:
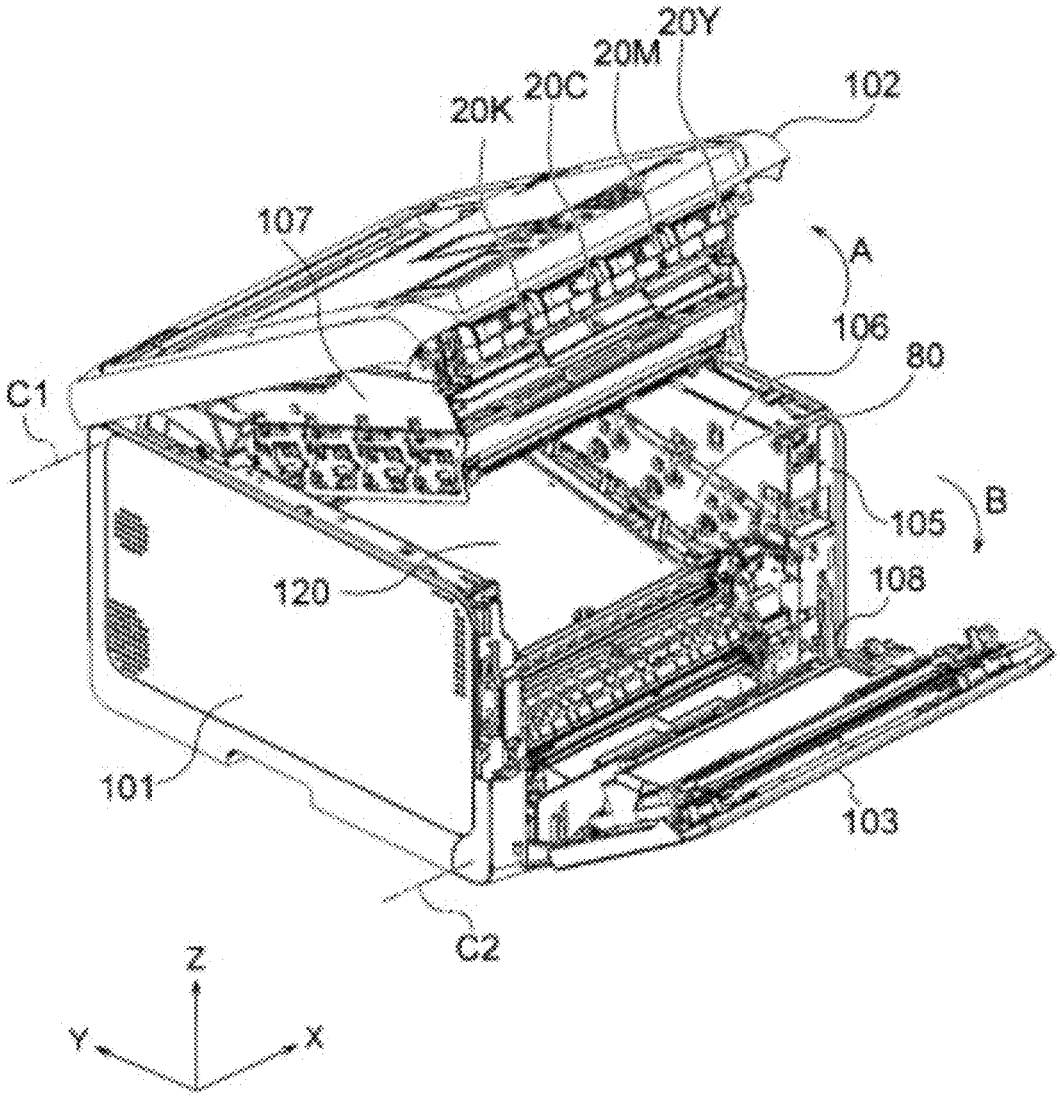
FIG. 5 is a perspective view showing a state where a top cover and a front cover of the image forming apparatus of the first embodiment are opened.

FIG. 5 is a diagram showing a state where the top cover 102 and the front cover 103 of the image forming apparatus 1 are opened. The top cover 102 is swingably supported by a swing shaft C1 in the X direction installed on the chassis 101. The swing shaft C1 is installed on the +Y direction end and +Z direction end part of the chassis 101. By swinging the top cover 102 centering on the swing shaft C1, the top cover 102 can be opened as indicated with an arrow A in FIG. 5.

The front cover 103 is swingably supported by a swing shaft C2 in the X direction installed on the chassis 101. The swing shaft C2 is installed on the −Y direction end and −Z direction end part of the chassis 101. By swinging the front cover 103 centering on the swing shaft C2, the front cover 103 can be opened as indicated with an arrow B in FIG. 5.

As mentioned above, the toner supply unit 2 (that is, the toner cartridges 20K, 20C, 20M, and 20Y, and the toner ducts 22K, 22C, 22M, and 22Y) is supported by the top cover 102. Therefore, when the top cover 102 is opened, the toner supply unit 2 also swings in a direction indicated with the arrow A.

Also, the process units 10K, 10C, 10M, and 10Y are attached to a basket frame 107 that swings with the top cover 102 in one unified body. Each of the process units 10 has a rotating member such as the photosensitive drum 11, to which a drive force is transmitted from the chassis 101 side.

Therefore, the front cover 103 is opened before opening the top cover 102, and the transmission of drive forces to the process units 10 is cut off interlocking mechanically with the opening action of the front cover 103. The transmission of the drive forces to the process units 10 is mentioned below.

Because the process units 10K, 10C, 10M, and 10Y are opened together with the top cover 102, top part of the transfer unit 120 becomes accessible from the outside, allowing a jammed medium P to be easily removed. Note that replacing the toner cartridges 20 can be performed in a state where the front cover 103 is open.

Figure 6:
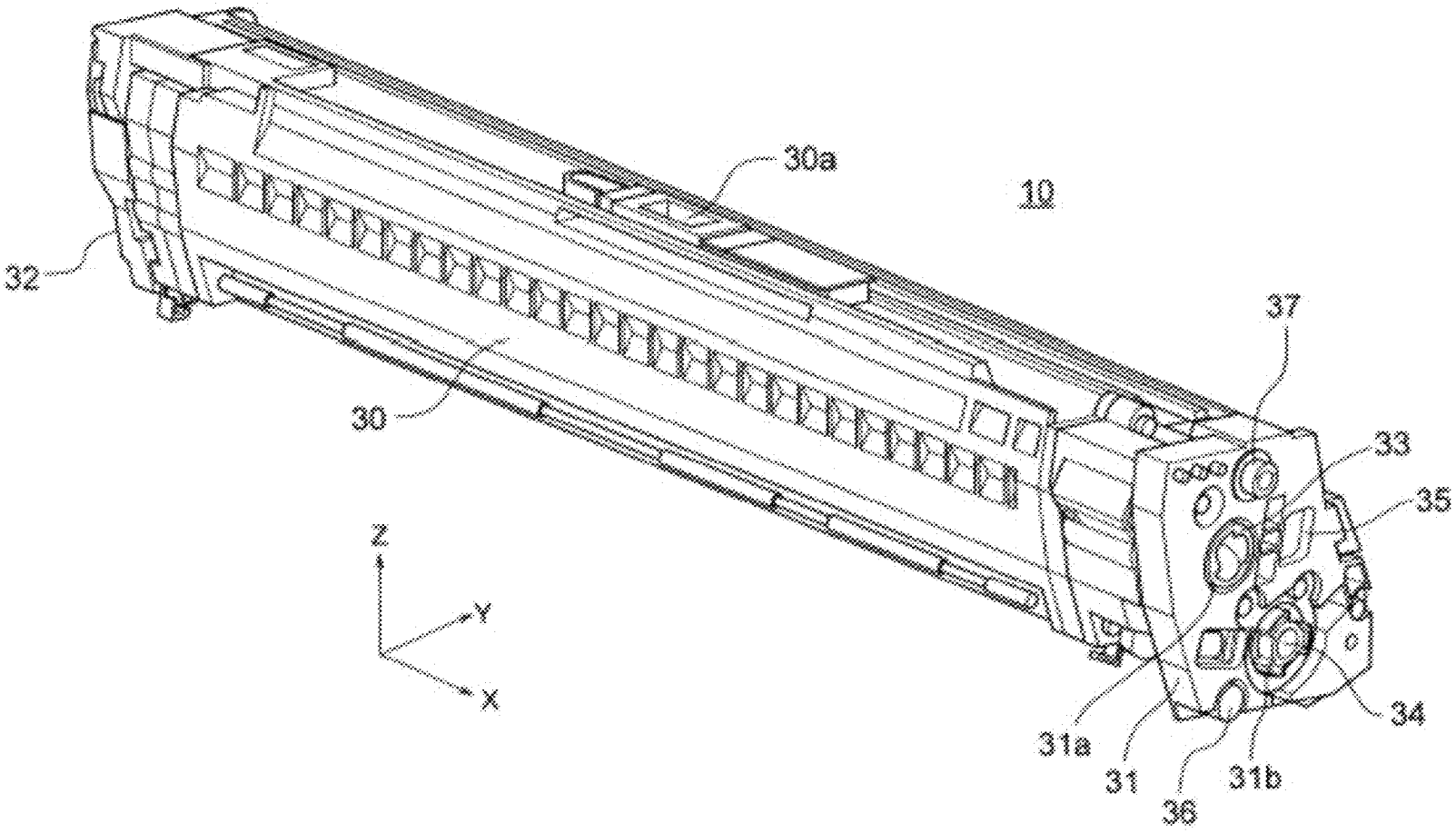
FIG. 6 is a perspective view showing the process unit of the first embodiment.

FIG. 6 is a perspective view showing the process unit 10. The process unit 10 has the unit frame 30 elongated in the X direction, and side frames 31 and 32 formed on its both ends in the X direction. The unit frame 30 accommodates the photosensitive drum 11, the charging roller 12, the development roller 14, the supply roller 15, and the development blade 16. Formed on the top part of the unit frame 30 is a toner inlet 30*a* that accepts toner from the toner duct 22.

The process unit 10 has a development roller combining part 33 as a drive force receiving part (first drive force receiving part) that receives a drive force for rotating the development roller 14, and a photosensitive drum combining part 34 as a drive force receiving part (second drive force receiving part) that receives a drive force for rotating the photosensitive drum 11.

The development roller combining part 33 is fixed to the shaft of the development roller 14. The photosensitive drum combining part 34 is fixed to the shaft of the photosensitive drum 11. Formed on the side frame 31 are openings 31*a* and 31*b* for exposing the development roller combining part 33 and the photosensitive drum combining part 34, respectively.

Also, installed on the side frame 31 is an opening 35 that introduces air (that is, cooling air) blown from an air blowing port 53 mentioned below into the process unit 10.

In the process unit 10, heat generation in the contact part between the development roller 14 and the development blade 16 is relatively large, the opening 35 (and the below-mentioned air blowing port 53) of the side frame 31 should desirably be in a position opposing in the X direction the contact part between the development roller 14 and the development blade 16. However, it is not limited to this position.

Figure 7:
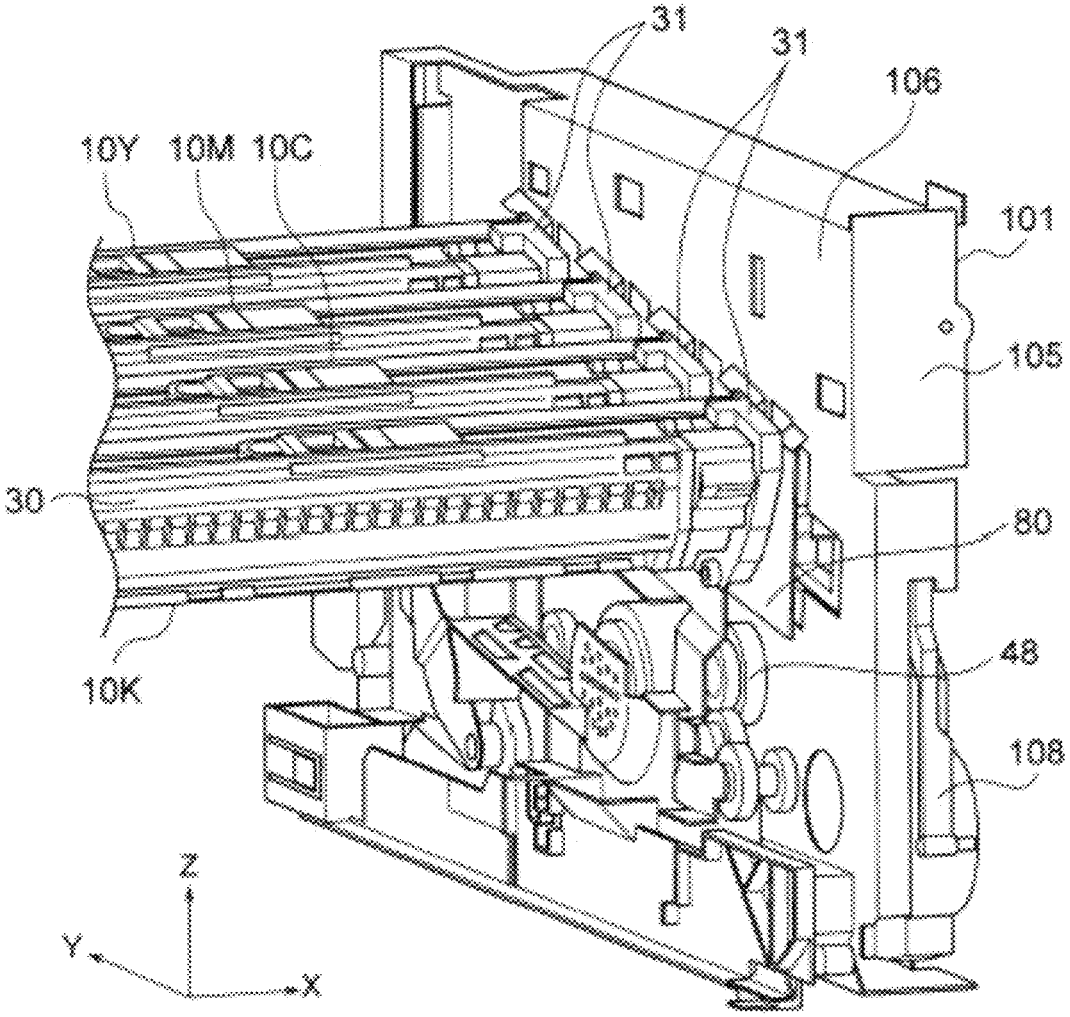
FIG. 7 is a perspective view showing a chassis and the process units of the first embodiment.

FIG. 7 is a perspective view showing the process units 10K, 10C, 10M, and 10Y, and a chassis side part 105 of the chassis 101. A drive force transmission part 6 (FIG. 12) that transmits drive forces to the process units 10 is installed on the +X direction side part (chassis side part) 105 of the chassis 101, and is covered with an inner cover 106.

Figure 8:
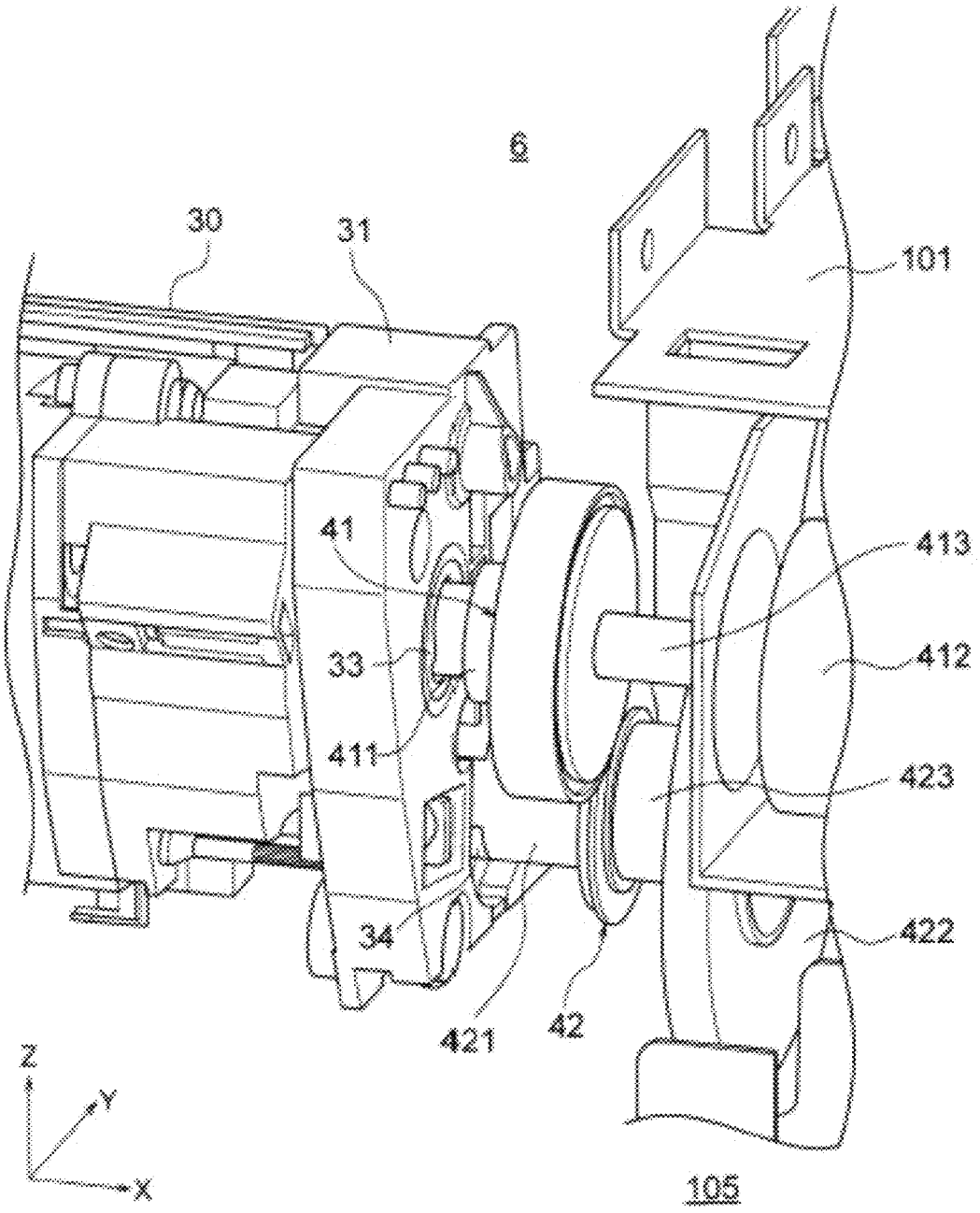
FIG. 8 is a perspective view showing part of a drive force transmission part for the process units of the first embodiment.

FIG. 8 is a perspective view showing part of the drive force transmission part 6. In FIG. 8, the inner cover 106 shown in FIG. 7 is omitted. The drive force transmission part 6 has development roller couplings 41 as engagement parts (first engagement parts) that engage with the development roller combining parts 33, and photosensitive drum couplings 42 as engagement parts (second engagement parts) that engage with the photosensitive drum combining parts 34 of the process units 10. These couplings 41 and 42 are attached to the chassis 101 rotatably centering on the X direction rotation axis.

The development roller coupling 41 is internally provided with an Oldham coupling mechanism and thereby configured so that even if there is a slight axial shift with the development roller combining part 33, it can absorb the axial shift and transmit a drive force. In the same manner, the photosensitive drum coupling 42 is internally provided with an Oldham coupling mechanism and thereby configured so that it can absorb an axial shift with the photosensitive drum combining part 34 and transmit a drive force.

On its −X direction end part, the development roller coupling 41 has an engagement shaft part 411 that engages with the development roller combining part 33. Also, attached to a shaft 413 that is the rotation shaft of the development roller coupling 41 is a gear 412 to which a drive force from a drive motor 17 (FIG. 9) is transmitted.

On its −X direction end part, the photosensitive drum coupling 42 has an engagement shaft part 421 that engages with the photosensitive drum combining part 34. Also, attached to a shaft 423 that is the rotation shaft of the photosensitive drum coupling 42 is a gear 422 to which a drive force from the drive motor 17 is transmitted.

Figure 9:
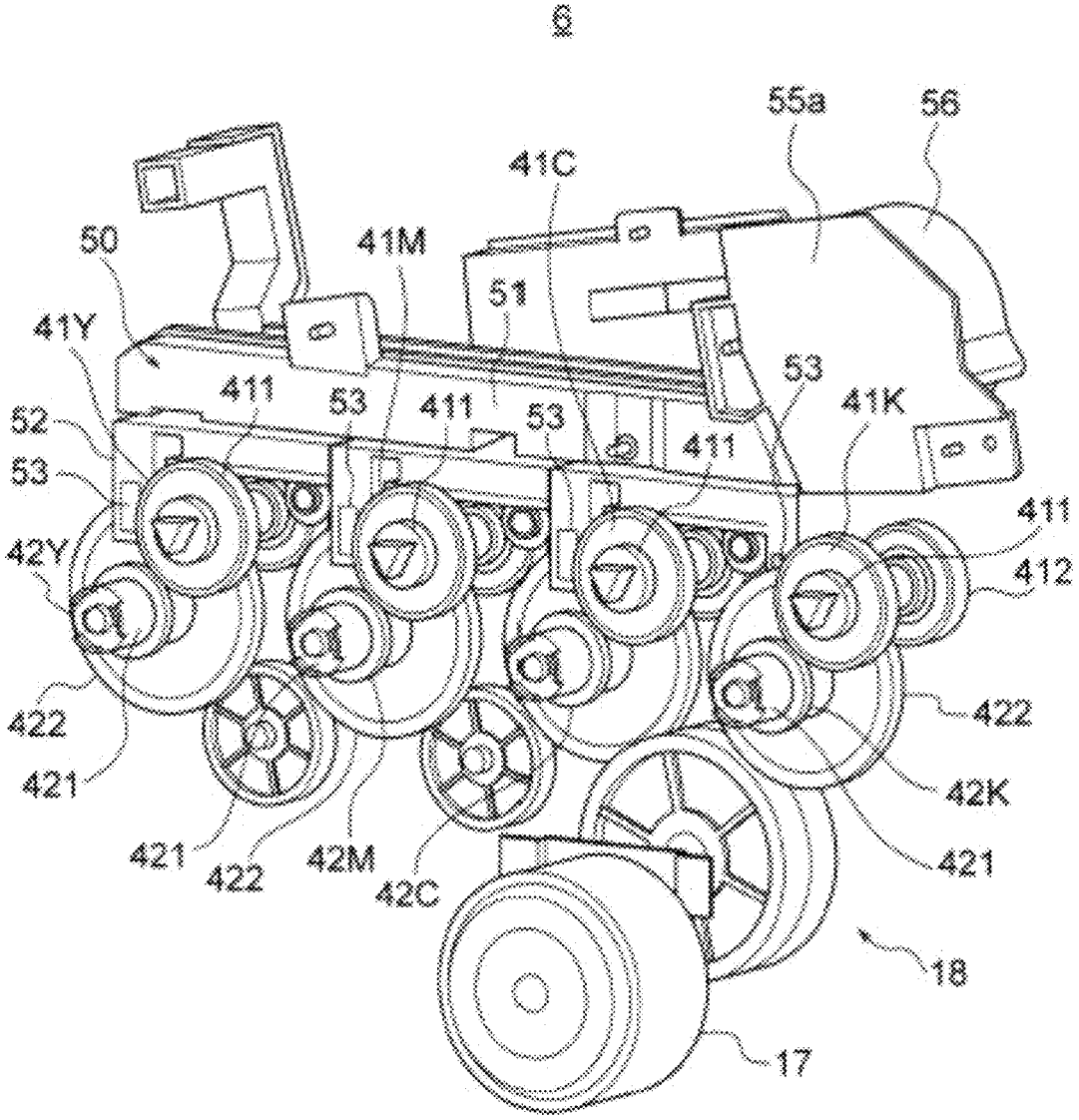
FIG. 9 is a perspective view showing part of the drive force transmission part for the process units of the first embodiment.

FIG. 9 is a perspective view showing part of the drive force transmission part 6. The development roller couplings 41 corresponding to the process units 10K, 10C, 10M, and 10Y are called development roller couplings 41K, 41C, 41M, and 41Y, respectively. In the same manner, the photosensitive drum couplings 42 corresponding to the process units 10K, 10C, 10M, and 10Y are called photosensitive drum couplings 42K, 42C, 42M, and 42Y, respectively.

The drive force of the drive motor 17 is transmitted through a transmission mechanism 18 having a gear array to the gears 412 of the development roller couplings 41K, 41C, 41M, and 41Y, and the gears 422 of the photosensitive drum couplings 42K, 42C, 42M, and 42Y.

Figure 10:
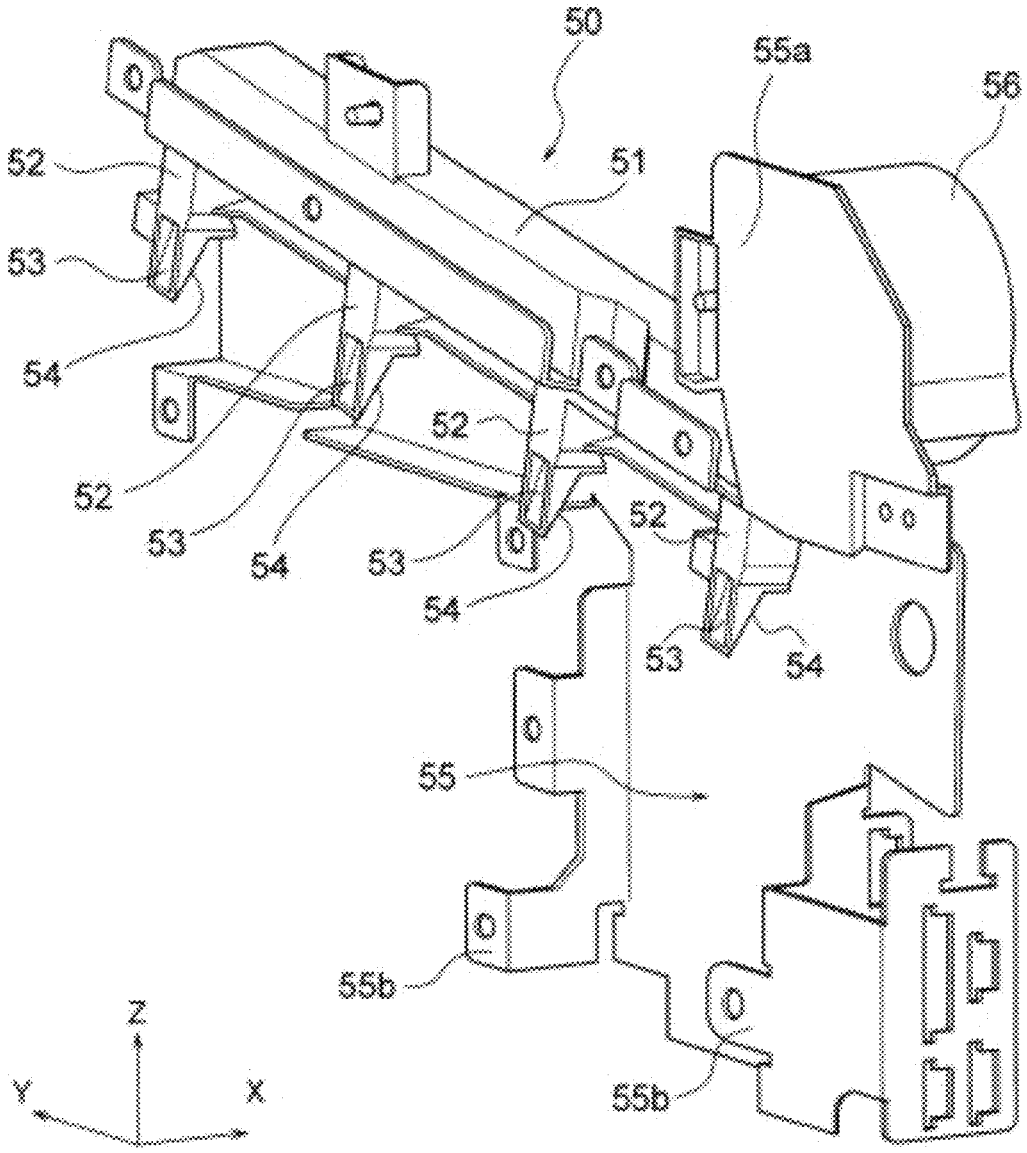
FIG. 10 is a perspective view showing a side plate and an air blowing duct of the first embodiment.
Figure 11:
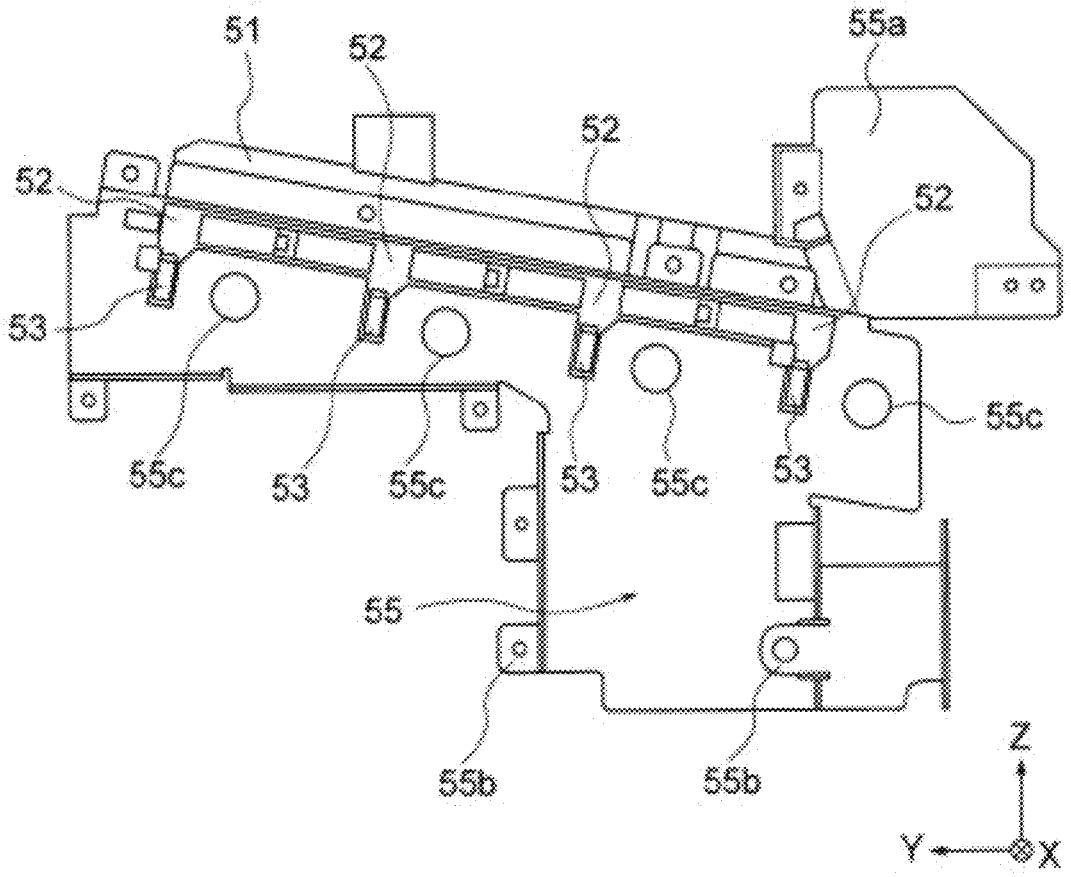
FIG. 11 is a diagram of the side plate and the air blowing duct of the first embodiment viewed from the process unit side.

FIG. 10 is a perspective view showing a side plate 55 disposed on the chassis side part 105, and an air blowing duct 50 attached to it. FIG. 11 is a diagram viewing the side plate 55 from the process unit 10 side. As shown in FIG. 10, the side plate 55 is formed by bending a plate-shape member.

Formed on the upper end part (+Z direction end part) of the side plate 55 is a motor supporting part 55*a* to which an air blowing fan 56 is attached. The air blowing fan 56 is attached to the +X side (opposite side of the process unit 10) of the motor supporting part 55*a*.

Attached to the side plate 55 is the air blowing duct 50 as an air blowing part adjacent to the +Y side of the motor supporting part 55*a*. The air blowing duct 50 constitutes an air blowing route to blow cooling air sent from the air blowing fan 56 to the process units 10. The air blowing duct 50 has a main duct 51 that extends in the unit array direction (approximate Y direction) and forms the main part of the air blowing route, and four branch ducts 52 that branch from the main duct 51.

The four branch ducts 52 extend in approximately the −Z direction from the main duct 51 and oppose the side frames 31 (FIG. 6) of the process units 10K, 10C, 10M, and 10Y. Formed on the tip of each of the branch ducts 52 is the air blowing port 53 to send out cooling air toward the process unit 10. The air blowing port 53 is formed in a position opposing the above-mentioned opening 35 (FIG. 6).

Formed at each of the tip of the branch duct 52 is an inclined wall 54 that is inclined so as to send out cooling air flowing up in approximately the −Z direction from the main duct 51 through the air blowing port 53 in the −X direction.

Also, the side plate 55 has a plurality of fixing parts 55*b* to which a below-mentioned cover member 80 (FIG. 15) is fixed, and four hole parts 55*c* (FIG. 11) that let shafts 413 of the development roller couplings 41 of the process units 10 pass through.

Figure 12:
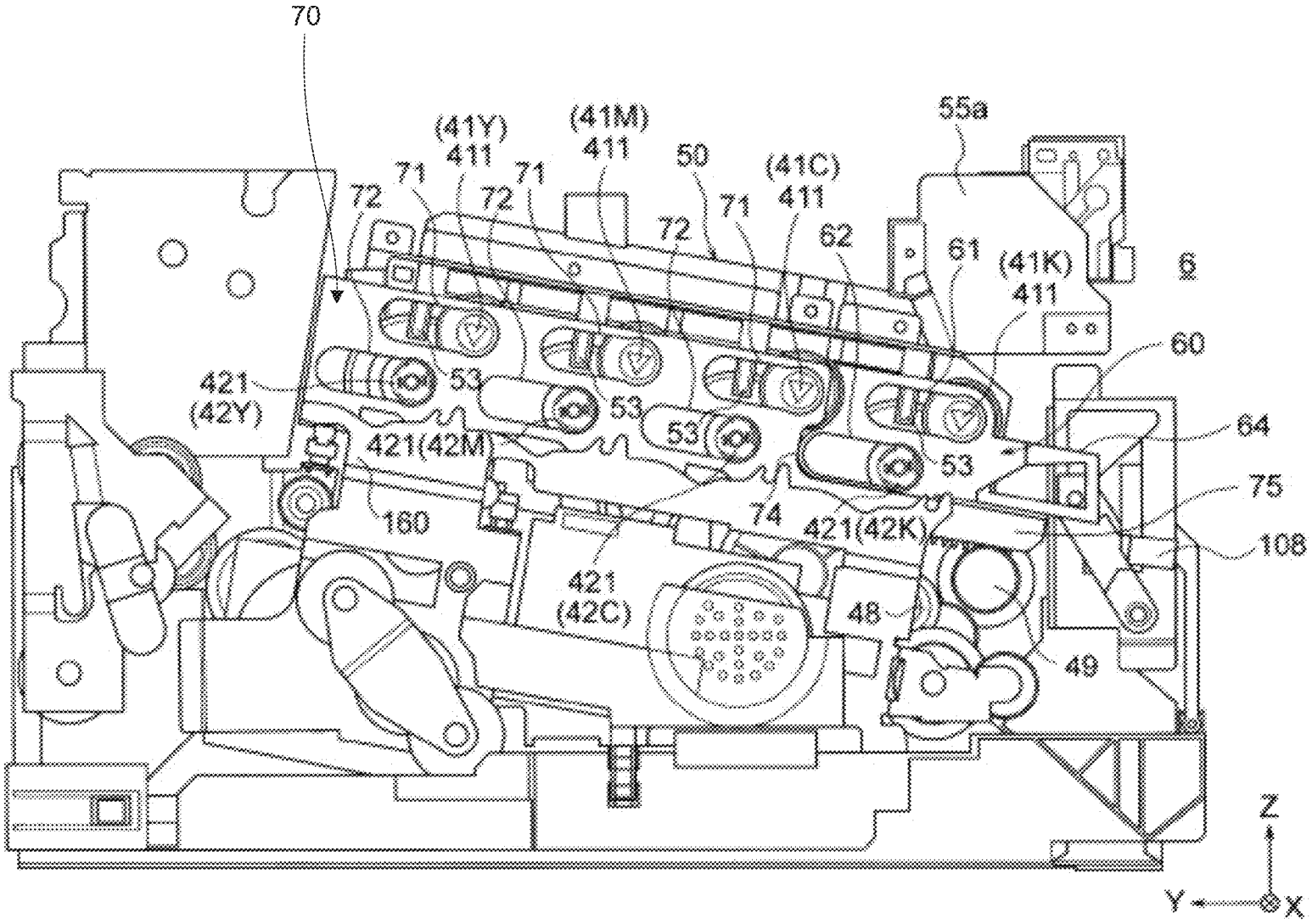
FIG. 12 is a diagram of the drive force transmission part of the first embodiment viewed from the process unit side.

FIG. 12 is a diagram viewing the drive force transmission part 6 from the process unit 10 side. The drive force transmission part 6 has a first slider 60 that moves the development roller coupling 41K and the photosensitive drum coupling 42K in the X direction, and a second slider 70 as an air flow rate changing part (movable part) that moves the development roller couplings 41C, 41M, and 41Y, and the photosensitive drum couplings 42C, 42M, and 42Y in the X direction.

Both the first slider 60 and the second slider 70 are elongated in the unit array direction (approximate Y direction), and move straight in the unit array direction. The first slider 60 and the second slider 70 constitute a switching mechanism that switches the transmission route of a drive force in the drive force transmission part 6. The position of the first slider 60 and the second slider 70 shown in FIG. 12 is referred to as a reference position (first position).

As shown in FIG. 12, the first slider 60 has an opening 61 to let the engagement shaft part 411 of the development roller coupling 41K pass through, and an opening 62 to let the engagement shaft part 421 of the photosensitive drum coupling 42K pass through. The openings 61 and 62 both have a shape elongated in the longitudinal direction of the first slider 60.

When the first slider 60 is in the reference position, the engagement shaft part 411 of the development roller coupling 41K is positioned at the −Y direction end part of the opening 61, and the engagement shaft part 421 of the photosensitive drum coupling 42K is positioned at the −Y direction end part of the opening 62. In FIG. 12, they are positioned at the lower right in these openings.

Formed at the −Y direction end part of the first slider 60 is a lever link part 64 that is linked with a swing lever 108 installed on the chassis 101.

The second slider 70 has openings 71 to let the engagement shaft parts 411 of the development roller couplings 41C, 41M, and 41Y pass through, and openings 72 to let the engagement shaft parts 421 of the photosensitive drum couplings 42C, 42M, and 42Y pass through. The openings 71 and 72 both have a shape elongated in the longitudinal direction of the second slider 70.

When the second slider 70 is in the reference position, the engagement shaft parts 411 of the development roller couplings 41C, 41M, and 41Y are positioned at the −Y direction end part of the openings 71, and the engagement shaft parts 421 of the photosensitive drum couplings 42C, 42M, and 42Y are positioned at the −Y direction end part of the openings 72.

Figure 13A:
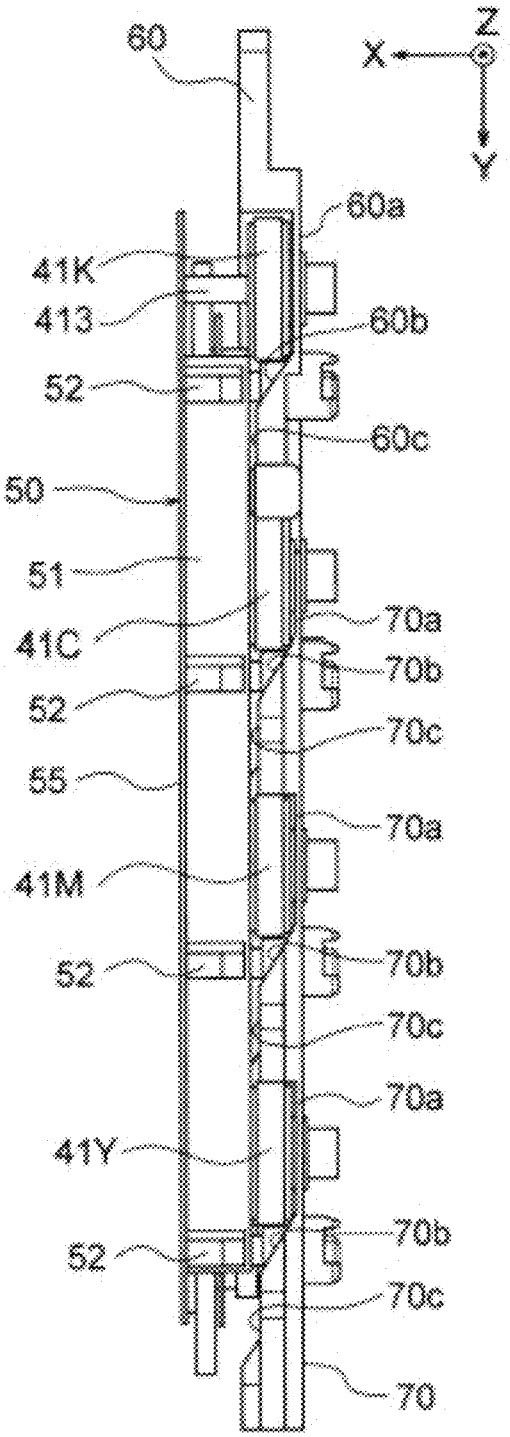
FIGS. 13A and 13B are top views showing the operations of a first slider and a second slider of the first embodiment.

FIG. 13A is a top view showing a state where both the first slider 60 and the second slider 70 of the drive force transmission part 6 are in the reference positions (first positions). The first slider 60 has a recessed part 60*a*, an inclined part 60*b*, and a projecting part 60*c* as contact parts contacting the development roller coupling 41K. The recessed part 60*a*, the inclined part 60*b*, and the projecting part 60*c* are arranged in this order in the +Y direction. The projecting part 60*c* protrudes in the +X direction relative to the recessed part 60*a*, and the inclined part 60*b* extends so as to connect the recessed part 60*a* and the projecting part 60*c*.

The development roller coupling 41K is biased in the −X direction by a bias member 63 (FIG. 14A) such as a spring, and in contact with one of the recessed part 60*a*, the inclined part 60*b*, and the projecting part 60*c* of the first slider 60.

In FIG. 13A, the development roller coupling 41K is in contact with the recessed part 60*a*. That is, the development roller coupling 41K is at the −X direction end part (the closest position to the process unit 10) within its moving range.

Figure 13B:
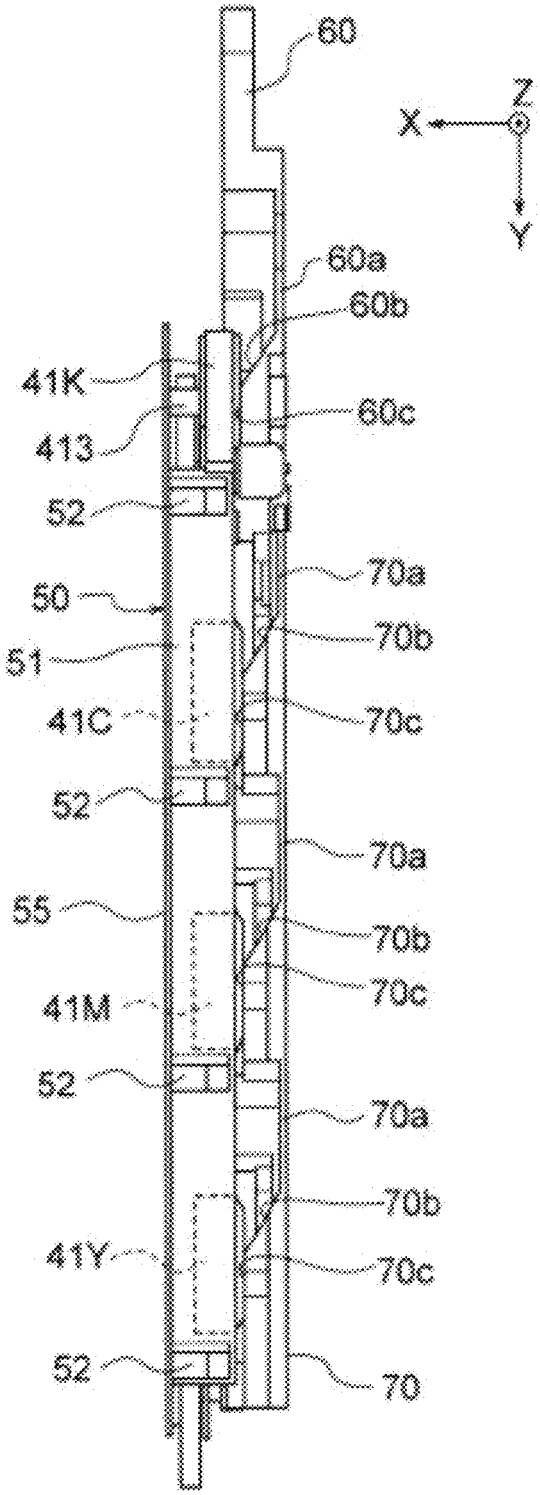

FIG. 13B is a top view showing a state where the first slider 60 and the second slider 70 of the drive force transmission part 6 have moved in the −Y direction. Once the first slider 60 has moved in the −Y direction, the development roller coupling 41K comes from the recessed part 60*a* via the inclined part 60*b* to contact the projecting part 60*c*. Thereby, the development roller coupling 41K moves in the +X direction (that is, the direction moving away from the process unit 10).

Returning to FIG. 13A, the second slider 70 has a recessed part 70*a*, an inclined part 70*b*, and a projecting part 70*c* as contact parts contacting each of the development roller couplings 41C, 41M, and 41Y. The recessed part 70*a*, the inclined part 70*b*, and the projecting part 70*c* are arranged in this order in the +Y direction. The projecting part 70*c* is positioned in the +X direction relative to the recessed part 70*a*. The inclined part 70*b* extends so as to connect the recessed part 70*a* and the projecting part 70*c*.

Each of the development roller couplings 41C, 41M, and 41Y is biased in the −X direction by a bias member 73 (FIG. 14A) such as a spring, and in contact with one of the recessed part 70*a*, the inclined part 70*b*, and the projecting part 70*c* of the second slider 70.

In FIG. 13A, each of the development roller couplings 41C, 41M, and 41Y is in contact with the recessed part 70*a*. That is, each of the development roller couplings 41C, 41M, and 41Y is at the −X direction end part (the closest position to the process unit 10) within its moving range.

As shown in FIG. 13B, once the second slider 70 has moved in the −Y direction, each of the development roller couplings 41C, 41M, and 41Y comes from the recessed part 70*a* via the inclined part 70*b* to contact the projecting part 70*c*. Thereby, all the development roller couplings 41C, 41M, and 41Y move in the +X direction (that is, the direction moving away from the process unit 10).

Note that the position of the first slider 60 and the second slider 70 shown in FIG. 13B is called a cut-off position (second position, or non-engaged position).

Figures 14A, 14B, 14C:
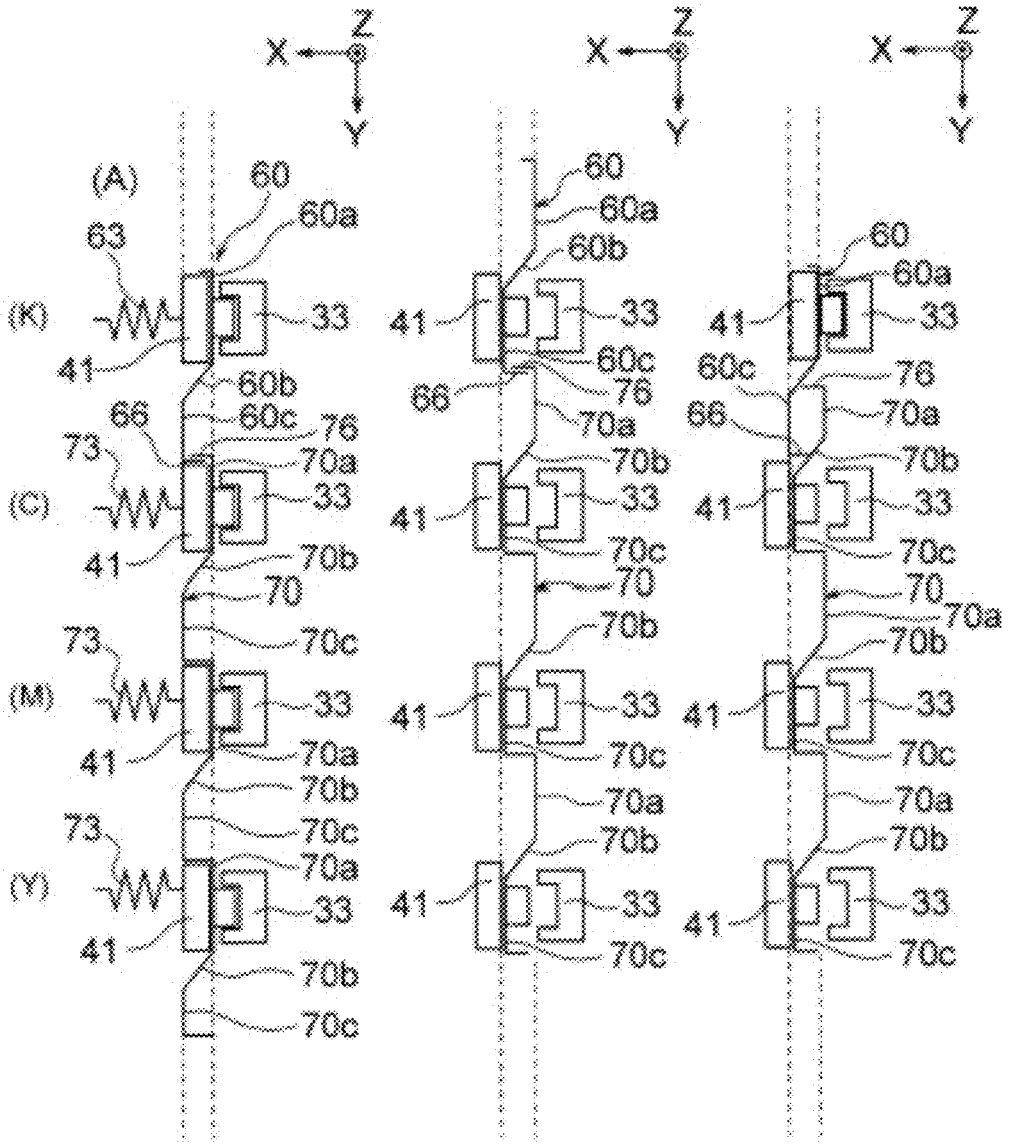
FIGS. 14A-14C are schematic diagrams showing the operations of the first slider and the second slider of the first embodiment.

FIGS. 14A-14C are schematic diagrams for explaining the operations of the first slider 60 and the second slider 70.

FIG. 14A shows a state where both the first slider 60 and the second slider 70 are in the reference positions.

FIG. 14B shows a state where both the first slider 60 and the second slider 70 have moved in the −Y direction from the reference positions and are in the cut-off positions.

FIG. 14C shows a state where the first slider 60 is the reference position, and the second slider 70 has moved in the −Y direction from the reference position and is in the cut-off position.

Formed at the +Y direction end part of the first slider 60 is a contact part 66. Formed at the −Y direction end part of the second slider 70 is a contact part 76. The contact part 66 of the first slider 60 and the contact part 76 of the second slider 70 are configured so as to allow contacting each other.

In the state shown in FIG. 14A, both the first slider 60 and the second slider 70 are in the reference positions (first positions). Therefore, the development roller coupling 41K is positioned in the recessed part 60*a* of the first slider 60, and the development roller couplings 41C, 41M, and 41Y are positioned in the recessed parts 70*a* of the second slider 70.

Therefore, the development roller coupling 41K engages with the development roller combining part 33 of the process unit 10K. Also, the development roller couplings 41C, 41M, and 41Y engage with the development roller combining parts 33 of the process units 10C, 10M, and 10Y, respectively. That is, a drive force is transmitted to all the development rollers 14 of the process units 10K, 10C, 10M, and 10Y.

In the state shown in FIG. 14B, both the first slider 60 and the second slider 70 have moved in the −Y direction from the reference positions and reached the cut-off positions (second positions). This operation of the sliders 60 and 70 is performed by the user opening the front cover 103.

That is, once the user opens the front cover 103 (FIG. 5), the swing lever 108 linked with the front cover 103 rotates, and the first slider 60 moves in the −Y direction by an action of the lever link part 64 (FIG. 12). Then, by the contact parts 66 and 67 contacting each other, the second slider 70 moves in the −Y direction following the first slider 60.

Thereby, the development roller coupling 41K moves to the projecting part 60*c* via the inclined part 60*b* of the first slider 60, and each of the development roller couplings 41C, 41M, and 41Y moves to the projecting part 70*c* through the inclined part 70*b* of the second slider 70.

Therefore, the development roller coupling 41K separates from the development roller combining part 33 of the process unit 10K. Also, the development roller couplings 41C, 41M, and 41Y separate from the development roller combining parts 33 of the process units 10C, 10M, and 10Y, respectively. That is, drive force transmission to all the development rollers 14 of the process units 10K, 10C, 10M, and 10Y is cut off.

In the state shown in FIG. 14C, while the first slider 60 remains in the reference position, the second slider 70 has moved in the −Y direction from the reference position and reached the cut-off position. This operation of the second slider 70 is performed by a switching motor 48 shown in FIG. 12.

Installed at the +Y direction end part of the second slider 70 is a rack gear part 75 (FIG. 12), and engaged with this rack gear part 75 is a gear 49 that rotates by a switching motor 48. The second slider 70 moves straight in the unit array direction (approximate Y direction) by an engagement between the rack gear part 75 and the gear 49. On the other hand, the first slider 60 does not move.

Thereby, while the development roller coupling 41K remains positioned in the recessed part 60*a* of the first slider 60, each of the development roller couplings 41C, 41M, and 41Y moves to the projecting part 70*c* via the inclined part 70*b* of the second slider 70.

Therefore, the development roller coupling 41K engages with the development roller combining part 33 of the process unit 10K, and the development roller couplings 41C, 41M, and 41Y separate from the development roller combining parts 33 of the process units 10C, 10M, and 10Y, respectively. That is, although a drive force is transmitted to the development roller 14 of the process unit 10K, drive force transmission to the development rollers 14 of the process units 10C, 10M, 10Y is cut off.

Although the movements of the development roller couplings 41K, 41C, 41M, and 41Y have been explained here, by the operations of the sliders 60 and 70 shown in FIGS. 14A-14C, the photosensitive drum couplings 42K, 42C, 42M, and 42Y also move in the same manner as the development roller couplings 41K, 41C, 41M, and 41Y.

Therefore, in the state shown in FIG. 14A, a drive force is transmitted to all the development rollers 14 and the photosensitive drums 11 of the process units 10K, 10C, 10M, and 10Y. In other words, the process units 10K, 10C, 10M, and 10Y are all in the image forming state (first state). In this state, color printing is performed.

Also, in the state shown in FIG. 14B, drive force transmission to all the development rollers 14 and the photosensitive drums 11 of the process units 10K, 10C, 10M, and 10Y is cut off. In other words, the process units 10K, 10C, 10M, and 10*y* are all in the non-image forming state (second state). In this state, opening/closing of the top cover 102 is performed.

Also, in the state shown in FIG. 14C, a drive force is transmitted to the development roller 14 and the photosensitive drum 11 of the process unit 10K, and drive force transmission to the development rollers 14 and the photosensitive drums 11 of the process units 10C, 10M, and 10Y is cut off. In other words, the process unit 10K is in the image forming state, and the process units 10C, 10M, and 10Y are in the non-image forming state.

In this state, monochrome printing by the process unit 10K is performed. Therefore, during monochrome printing, the development rollers 14 and the photosensitive drums 11 of the process units 10C, 10M, and 10Y that are not used for printing can remain stopped.

Note that because the drive force transmission part 6 can switch the image forming state and the non-image forming state of the process units 10K, 10C, 10M, and 10Y, it is also called a switching part (or state changing part).

Figure 15:
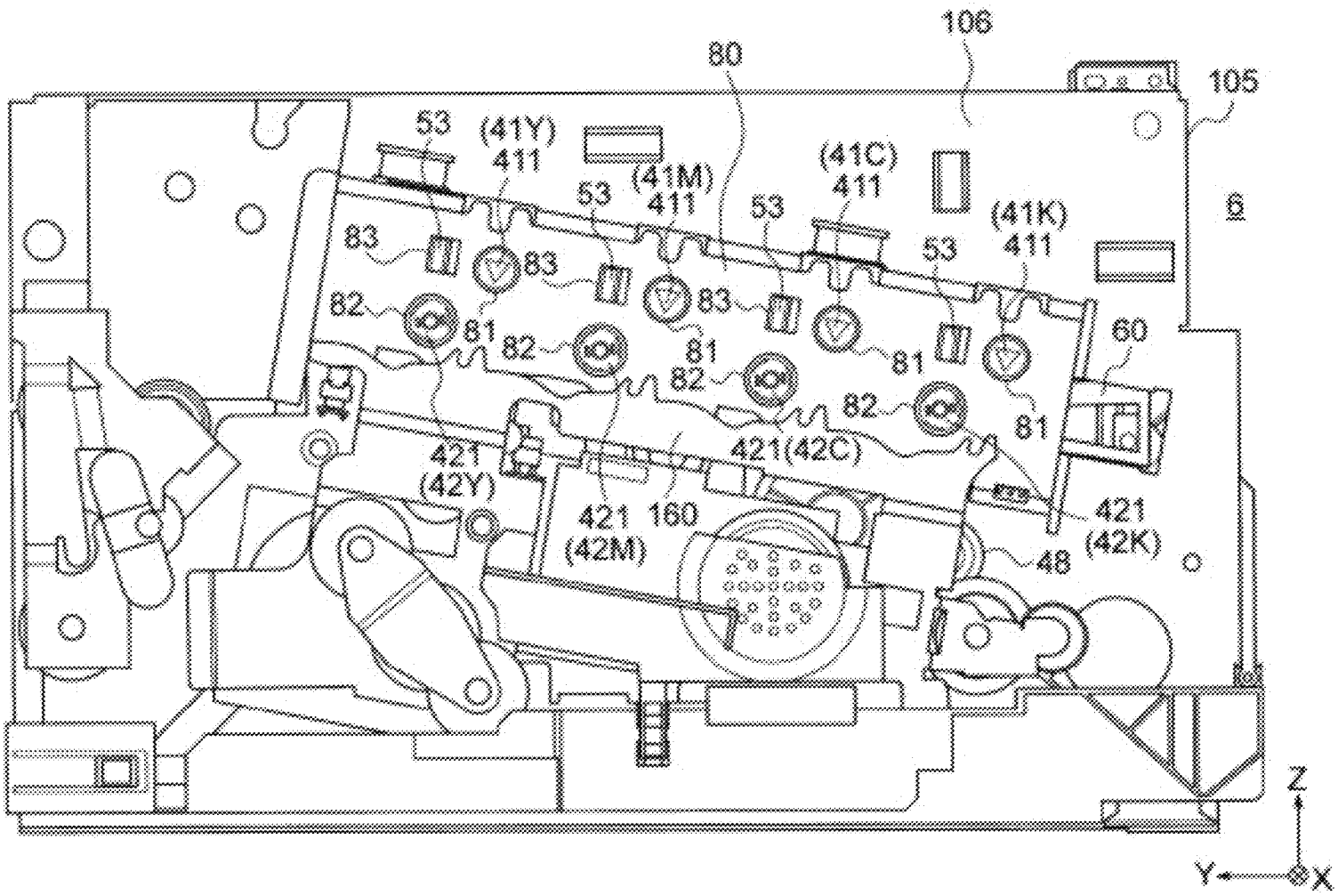
FIG. 15 is a diagram of a chassis side part of the first embodiment viewed from the process unit side.

FIG. 15 is a diagram viewing the chassis side part 105 of the chassis 101 from the process unit 10 side. The development roller couplings 41K, 41C, 41M, and 41Y, the photosensitive drum couplings 42K, 42C, 42M, and 42Y, the first slider 60, and the second slider 70 shown in FIG. 9 are covered with a cover member 80. The cover member 80 is fixed to the fixing parts 55*b* (FIG. 10) of the side plate 55.

The cover member 80 has hole parts 81 through which the engagement shaft parts 411 of the development roller couplings 41K, 41C, 41M, and 41Y are inserted, hole parts 82 through which the engagement shaft parts 421 of the photosensitive drum couplings 42K, 42C, 42M, and 42Y are inserted, and openings 83 through which cooling air from the air blowing ports 53 passes.

Figure 16:
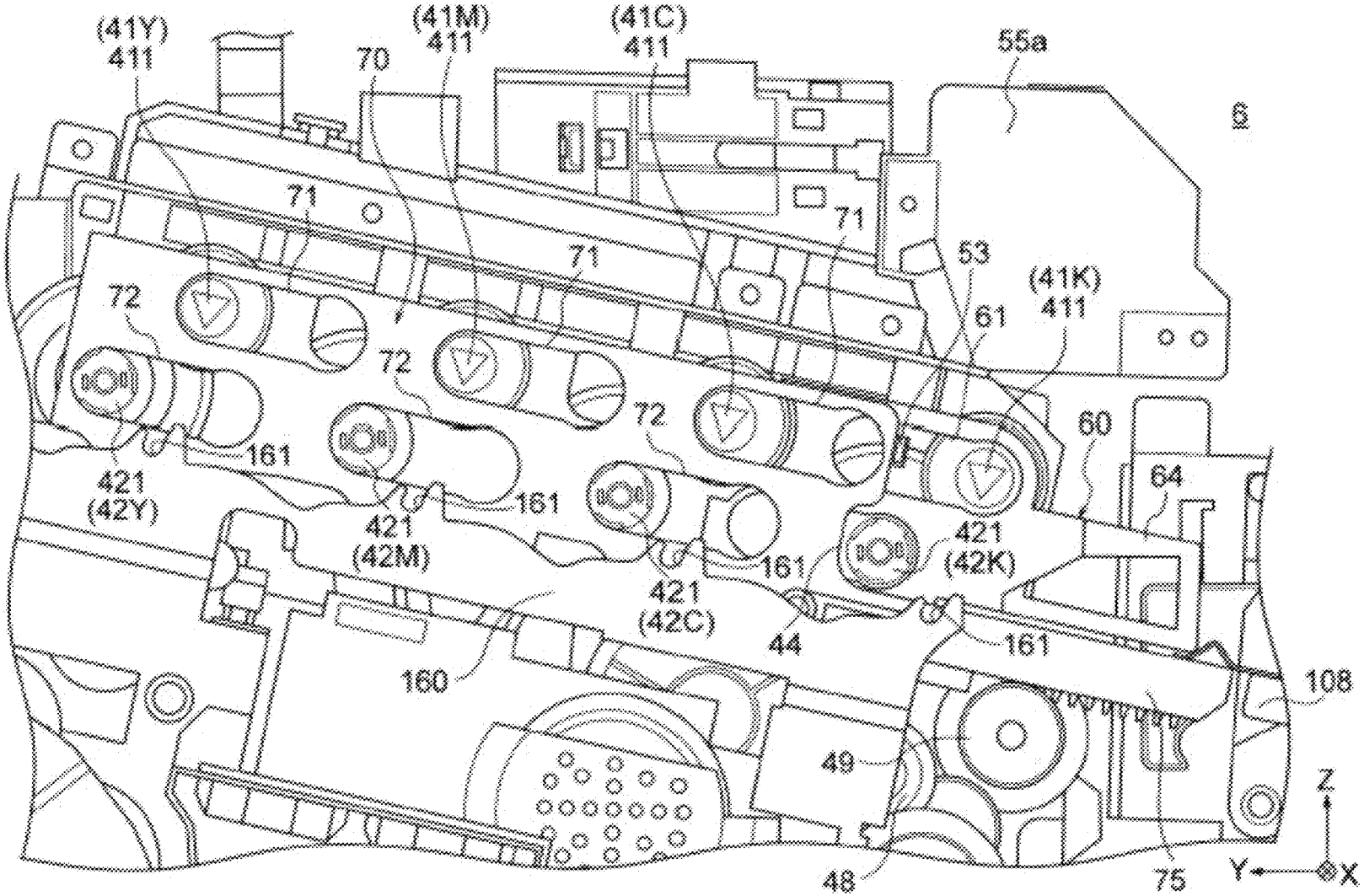
FIG. 16 is a diagram of the drive force transmission part of the first embodiment viewed from the process unit side.

FIG. 16 is a diagram viewing the drive force transmission part 6 from the process unit 10 side when the first slider 60 and the second slider 70 are in the state shown in FIG. 14C (that is, during monochrome printing).

When the second slider 70 is in the cut-off position shown in FIG. 14C, each of the engagement shaft parts 411 of the development roller couplings 41C, 41M, and 41Y is positioned at the +Y direction end part of the respective opening 71. Also, each of the engagement shaft parts 421 of the photosensitive drum couplings 42C, 42M, and 42Y is positioned at the +Y direction end part of the respective opening 72.

Furthermore, when the second slider 70 is in the cut-off position shown in FIG. 14C, among the four air blowing ports 53 of the air blowing duct 50, the three air blowing ports 53 corresponding to the process units 10C, 10M, and 10Y are closed with the second slider 70 (therefore, they are hidden behind the second slider 70 in FIG. 16). Of the second slider 70, the parts closing the three air blowing ports 53 are called closing parts. On the other hand, the air blowing port 53 corresponding to the black process unit 10K is not closed with the first slider 60 but is open.

Figure 17:
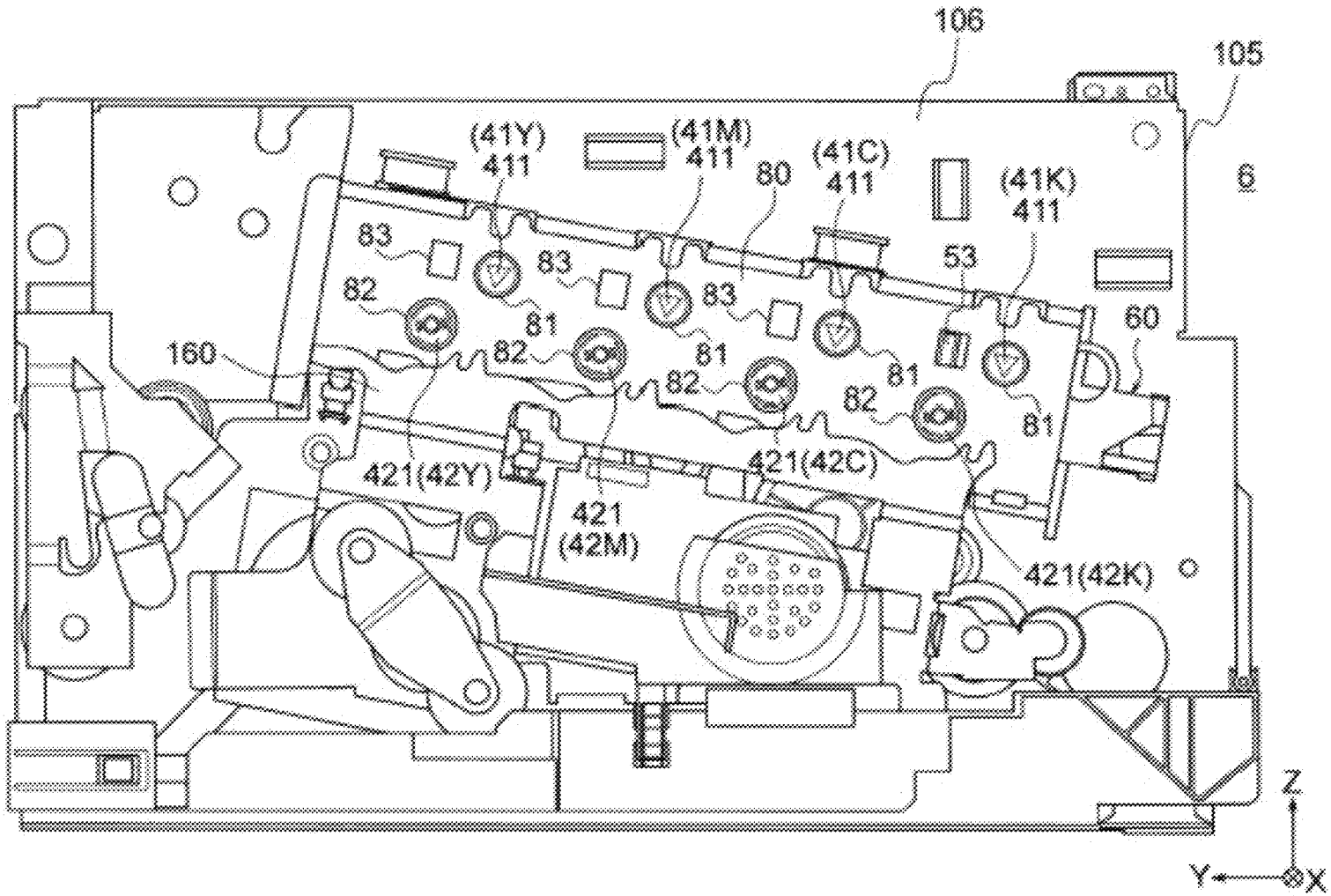
FIG. 17 is a diagram of the chassis side part of the first embodiment viewed from the process unit side.

FIG. 17 is a diagram viewing the chassis side part 105 from the process unit 10 side during monochrome printing. When viewed from the process unit 10 side, among the four openings 83 of the cover member 80, although the air blowing port 53 corresponding to the black process unit 10K is exposed through the opening 83, the three air blowing ports 53 corresponding to the other process units 10C, 10M, and 10Y are hidden.

Being configured in this manner, during monochrome printing, cooling air sent up through the air blowing duct 50 as an air blowing part is blown concentratedly to the black process unit 10K through one air blowing port 53.

That is, cooling air is not blown to the process units 10C, 10M, and 10Y where the photosensitive drums 11 and the development rollers 14 do not rotate (that is, in the non-image forming state), but cooling air is blown concentratedly to the process unit 10K where the photosensitive drum 11 and the development roller 14 rotate (that is, in the image forming state). Therefore, cooling air can be efficiently blown to the process unit 10K, which can be efficiently cooled.

<Control System of Image Forming Apparatus>

Next, explained is the control system of the image forming apparatus 1. FIG. 18 is a block diagram showing the control system of the image forming apparatus 1. The image forming apparatus 1 has a control device 200, an I/F (interface) control part 221, a receiving memory 222, an image data editing memory 223, the operation part 104, and a sensor group 225.

The image forming apparatus 1 is also provided with a power source control part 201, a head control part 206, a drive control part 207, a belt drive control part 208, a fuser control part 209, a fuser drive control part 210, and a sheet feeding and carrying control part 211.

The control device 200 has a microprocessor, ROM (Read Only Memory), RAM (Random Access Memory), an input/output port, a timer, etc. The control device 200 receives print data and control commands from a higher-level device through the I/F control part 221, and controls the operations of the image forming apparatus 1.

The receiving memory 222 tentatively stores the print data inputted through the I/F control part 221 from the upper-level device. The image data editing memory 223 receives the print data stored in the receiving memory 222 and also records image data formed by editing the print data.

The operation part 104 is provided with a display part (e.g., LEDs) that displays the state of the image forming apparatus 1, switches for an operator to input instructions, etc. The sensor group 225 includes various sensors for monitoring the operating state of the image forming apparatus 1, including toner remaining amount sensors that detect the amounts of remaining toners inside the process units 10, toner remaining amount sensors that detect the amounts of remaining toners in the toner cartridges 20, and a medium position sensor that detects the carrying position of the medium P for example.

The power source control part 201 controls the charging voltage power sources 202 that apply charging voltages to the charging rollers 12, the development voltage power sources 203 that apply development voltages to the development rollers 14, the supply voltage power sources 204 that apply supply voltages to the supply rollers 15, and the transfer voltage power sources 205 that apply transfer voltages to the transfer rollers 121. The head control part 206 sends the image data recorded in the image data editing memory 223 to the print heads 13 and controls the light emission of the print heads 13.

The drive control part 207 controls the drive motors 17 that rotate the development roller 14 and the photosensitive drum 11 of the process units 10. Note that the charging roller 12 rotates following the rotation of the photosensitive drum 11, and the supply roller 15 rotates by the transmitted rotation of the development roller 14 or the photosensitive drum 11. The belt drive control part 208 controls the belt motor 125 for driving the transfer belt 122.

The fuser control part 209 has a temperature adjusting circuit, and supplies an electric current to the heater 133 based on the output signals of a thermistor 134 of the fuser device 130. The fuser drive control part 210 controls the fuser motor 135 that rotates the fuser roller 131 (FIG. 2) of the fuser device 130. Note that the ejection rollers 141 and 142 rotate by the transmitted rotation of the fuser motor 135.

The sheet feeding and carrying control part 211 controls a sheet feeding motor 212 that rotates the pickup roller 112 and the feed roller 113, and a carrying motor 213 that rotates the carrying rollers 115 and 118.

Also, the control device 200 controls the toner supply motors 26 that drive the carrying spirals 25 for supplying toners from the toner cartridges 20 to the process units 10.

Also, the control device 200 controls the switching motor 48 that switches connection and cut-off of drive force transmission to the process units 10C, 10M, and 10Y, and the air blowing fan 56 that blows cooling air through the air blowing duct 50.

<Operations of Image Forming Apparatus>

Next, a print operation (an image forming operation) by the image forming apparatus 1 is explained referring to FIGS. 2 and 18. Upon receiving a print command and print data from the upper-level device through the I/F control part 221, the control device 200 of the image forming apparatus 1 starts the print operation.

During color printing, the print operation is performed in a state where both the first slider 60 and the second slider 70 are positioned in the reference positions (FIGS. 12 and 13). Therefore, the development roller couplings 41K, 41C, 41M, and 41Y and the photosensitive drum couplings 42K, 42C, 42M, and 42Y (FIG. 9) are engaged with all the development roller combining parts 33 and the photosensitive drum combining parts 34 (FIG. 6) of the process units 10K, 10C, 10M, and 10Y. Thereby, a drive force is transmitted to all the development rollers 14 and the photosensitive drums 11 of the process units 10K, 10C, 10M, and 10Y. In other words, the process units 10K, 10C, 10M, and 10Y are all in the image forming state.

Also, because both the first slider 60 and the second slider 70 are in the reference positions, all the air blowing ports 53 (FIG. 10) of the air blowing duct 50 are open. Therefore, cooling air sent from the air blowing fan 56 via the air blowing duct 50 is blown to all the process units 10K, 10C, 10M, and 10Y through the four air blowing ports 53.

When printing is started, the control device 200 starts supplying the medium P by the medium supply part 110. Specifically, the sheet feeding motor 212 is driven by the sheet feeding and carrying control part 211, thereby rotating the pickup roller 112 and the feed roller 113. The pickup roller 112 feeds out the medium P accommodated in the sheet feeding tray 111, and the feed roller 113 forwards the fed medium P to the carrying route. Also, the carrying rollers 115 and 118 rotate by the carrying motor 213, thereby carrying the medium P forwarded to the carrying route to the image forming part 100.

The control device 200 further has the belt drive control part 208 drive the belt motor 125 to rotate the drive roller 123, thereby having the transfer belt 122 travel. The transfer belt 122 carries the medium P by adsorb-holding it. The medium P passes through the process units 10K, 10C, 10M, and 10Y in that order.

Then, the control device 200 has the power source control part 201 apply the charging voltage, the development voltage, and the supply voltage respectively to the charging roller 12, the development roller 14, and the supply roller 15 of each of the process units 10.

The control device 200 also has the drive control part 207 rotate the drive motor 17 corresponding to each of the process unit 10, thereby rotating the development roller 14 and the photosensitive drum 11. Accompanying these rotations, the charging roller 12 and the supply roller 15 also rotate. The charging roller 12 uniformly charges the surface of the photosensitive drum 11.

The control device 200 further has the head control part 206 control the light emission of the print heads 13 based on image data for the individual colors. Each of the print heads 13 exposes the surface of the photosensitive drum 11 with light, forming an electrostatic latent image.

In each of the process units 10, toner is supplied to the development roller 14 by the supply roller 15, and a toner layer is formed on the surface of the development roller 14 by the development blade 16. The electrostatic latent image formed on the surface of the photosensitive drum 11 is developed with the toner on the surface of the development roller 14, becoming a toner image. The toner image formed on the surface of the photosensitive drum 11 is transferred to the medium P on the transfer belt 122 by the transfer voltage applied to the transfer roller 121 from the power source control part 201.

In this manner, individual color toner images formed in the process units 10K, 10C, 10M, and 10Y are sequentially transferred to the medium P and superimposed on one another. The medium P to which the individual color toner images are transferred is further carried by the transfer belt 122 and reaches the fuser device 130.

In the fuser device 130, the fuser roller 131 is heated to fusing temperature by the heater 133 and is rotating by the fuser motor 135. The medium P carried to the fuser device 130 is heated and pressed between the fuser roller 131 and the pressure application roller 132, thereby the toner image is fused to the medium P.

The medium P to which the toner image is fused is carried along the ejection carrying route and ejected to the outside of the image forming apparatus 1 by the ejection rollers 141 and 142 of the medium ejection part 140. The ejected medium P is stacked on the stacker part 143. Thereby, the print operation to the medium P is complete.

On the other hand, during monochrome printing, the control device 200 drives the switching motor 48 to move the second slider 70 to the cut-off position shown in FIG. 14C. Therefore, the development roller combining parts 33 and the photosensitive drum combining parts 34 of the process units 10C, 10M, and 10Y are not engaged with the development roller couplings 41C, 41M, and 41Y, and the photosensitive drum couplings 42C, 42M, and 42Y, respectively.

Therefore, drive forces are transmitted to the development roller 14 and the photosensitive drum 11 of the process unit 10K, and no drive force is transmitted to the development rollers 14 and the photosensitive drums 11 of the process units 10C, 10M, and 10Y. In other words, although the process unit 10K is in the image forming state, the process units 10C, 10M, and 10Y are in the non-image forming state.

Also, because the first slider 60 and the second slider 70 are in the positions shown in FIG. 14C, as shown in FIG. 16, the air blowing port 53 corresponding to the process unit 10K is opened, and the other air blowing ports 53 are closed with the second slider 70. Therefore, cooling air from the air blowing duct 50 is blown concentratedly to the process unit 10K.

In this state, the control device 200 has the power source control part 201 apply the charging voltage, the development voltage, and the supply voltage to the charging roller 12, the development roller 14, and the supply roller 15 of the process unit 10K, respectively.

The control device 200 also has the drive control part 207 rotate the drive motor 17 of the process unit 10K to rotate the development roller 14 and the photosensitive drum 11. Accompanying these rotations, the charging roller 12 and the supply roller 15 also rotate. The charging roller 12 uniformly charges the surface of the photosensitive drum 11.

The control device 200 further has the head control part 206 control the light emission of the print head 13 corresponding to the process unit 10K based on black image data. The print head 13 exposes the surface of the photosensitive drum 11 with light, forming an electrostatic latent image.

The electrostatic latent image formed on the surface of the photosensitive drum 11 is developed with toner on the surface of the development roller 14, becoming a toner image. Then, it is transferred to the medium P on the transfer belt 122 by the transfer voltage applied to the transfer roller 121 from the power source control part 201.

In this manner, the black toner image is transferred to the medium P. Afterwards, in the same manner as in color printing, fusing of the toner image and ejection of the medium P are performed.

<Actions>

Next, explained are actions of this embodiment. Inside each of the process units 10, the photosensitive drum 11, the charging roller 12, the development roller 14, and the supply roller 15 rotate in contact with one another, thereby heat is generated. Especially, because the development blade 16 is pressed against the surface of the development roller 14, heat due to a friction occurs. If the surface temperature of the photosensitive drum 11 rises due to these occurrences of heat, it leads to deterioration in image quality.

By blowing air into the process units 10 through the air blowing ports 53 from the air blowing fan 56, the interiors of the process units 10 can be cooled. Thereby, the rise in the surface temperature of the photosensitive drums 11 can be suppressed, improving image quality.

In the image forming apparatus 1, in general, monochrome printing is performed more frequently than color printing. Therefore, there are models that make the capacity of the black toner cartridge larger than those of the other toner cartridges, and also models that make the printing speed during monochrome printing higher than that during color printing.

Therefore, temperature in the black process unit 10K tends to rise more easily than in the other process units 10C, 10M, and 10Y, therefore the improvement in cooling efficiency of the black process unit 10K is an issue.

In the image forming apparatus 1 of the first embodiment, during monochrome printing, the air blowing port 53 corresponding to the process unit 10K is opened, and the air blowing ports 53 corresponding to the process units 10C, 10M, and 10Y are closed. Therefore, cooling air sent by the air blowing fan 56 is concentratedly blown to the process unit 10K, improving cooling efficiency of the process unit 10K.

Also, because cooling efficiency of the process unit 10K is improved, there is no need to lower the print speed for the purpose of suppressing a temperature rise, therefore time required for the print process can be shortened.

Also, during monochrome printing, drive forces to rotate the development roller 14 and the photosensitive drum 11 are not transmitted to the process unit 10C, 10M, or 10Y. Therefore, no heat is generated inside the process units 10C, 10M, or 10Y, thereby no temperature rise occurs due to having no cooling air blown.

Also, because the air blowing ports 53 are opened/closed interlocking mechanically with switching drive force transmission to the process units 10C, 10M, and 10Y (that is, by the movement of the second slider 70), the operation to blow cooling air concentratedly to the black process unit 10K during monochrome printing can be realized with a simple configuration.

Especially, because the air blowing ports 53 are opened/closed with the second slider 70 that switches drive force transmission to the process units 10C, 10M, and 10Y, there is no need to install independent mechanisms or shutters for opening/closing the air blowing ports 53, simplifying the configuration and reducing the manufacturing cost of the image forming apparatus 1.

Note that, once the user opens the front cover 103, as mentioned above, the first slider 60 and the second slider 70 move to the cut-off positions shown in FIG. 14B. In this case, the air blowing port 53 corresponding to the process unit 10K is closed with the first slider 60, and the air blowing ports 53 corresponding to the process units 10C, 10M, and 10Y are closed with the second slider 70. Therefore, an invasion of foreign bodies to the interior of the air blowing duct 50 can be prevented.

<Efficacy of Embodiment>

As explained above, the image forming apparatus 1 of the first embodiment has the air blowing duct 50 (air blowing part) that blows air toward the process units 10C, 10M, and 10Y, and the second slider 70 (air flow rate changing part) that changes the air flow rate from the air blow duct 50 interlocking mechanically with switching drive force transmission to the process units 10C, 10M, and 10Y (that is, switching between the image forming state and the non-image forming state of the process units 10C, 10M, and 10Y).

Therefore, in an operating mode where the process units 10C, 10M, and 10Y are not used (monochrome printing), air is blown concentratedly to the process unit 10K, thereby the process unit 10K can be efficiently cooled.

Especially, the air blowing ports 53 are opened in a state where drive force transmission to the process units 10C, 10M, and 10Y is connected, and the air blowing ports 53 are closed in a state where drive force transmission is cut off. Therefore, blowing air can be performed only when heat is generated inside the process units 10C, 10M, and 10Y, improving cooling efficiency.

Also, because the second slider 70 (movable part) that switches drive force transmission to the process units 10C, 10M, and 10Y opens/closes the air blowing ports 53, there is no need to install independent mechanisms or shutters for opening/closing the air blowing ports 53, allowing simplification of the configuration and reduction of the manufacturing cost of the image forming apparatus 1.

Also, each of the process units 10C, 10M, and 10Y has the development roller combining part 33 and the photosensitive drum combining part 34, and a drive force is transmitted to each of the process units 10C, 10M, and 10Y by the couplings 41 and 42 engaging with these combining parts 33 and 34. The second slider 70 moves the couplings 41 and 42 toward or away from the combining parts 33 and 34, and opens/closes the air blowing ports 53 in doing so. Therefore, opening/closing the air blowing ports 53 can be performed with a simpler configuration.

Also, by blowing air efficiently to the black process unit 10K having high frequency of use, a temperature rise in the process unit 10K can be suppressed, improving image quality.

Second Embodiment

Next, explained is the second embodiment of this invention. In the above-mentioned first embodiment, the air blowing ports 53 corresponding to the process units 10C, 10M, and 10Y were opened/closed with the second slider 70. As opposed to this, in the second embodiment, air blowing ports 53 are opened/closed by open/close doors 90.

The configuration to switch drive force transmission to the process units 10K, 10C, 10M, and 10Y is almost the same as the configuration explained in the first embodiment. However, openings 71 (FIG. 12) of a second slider 70 is longer than in the first embodiment, configured so that air blowing ports 53 are not closed even when the second slider 70 is in a position shown in FIG. 16.

Figure 19:
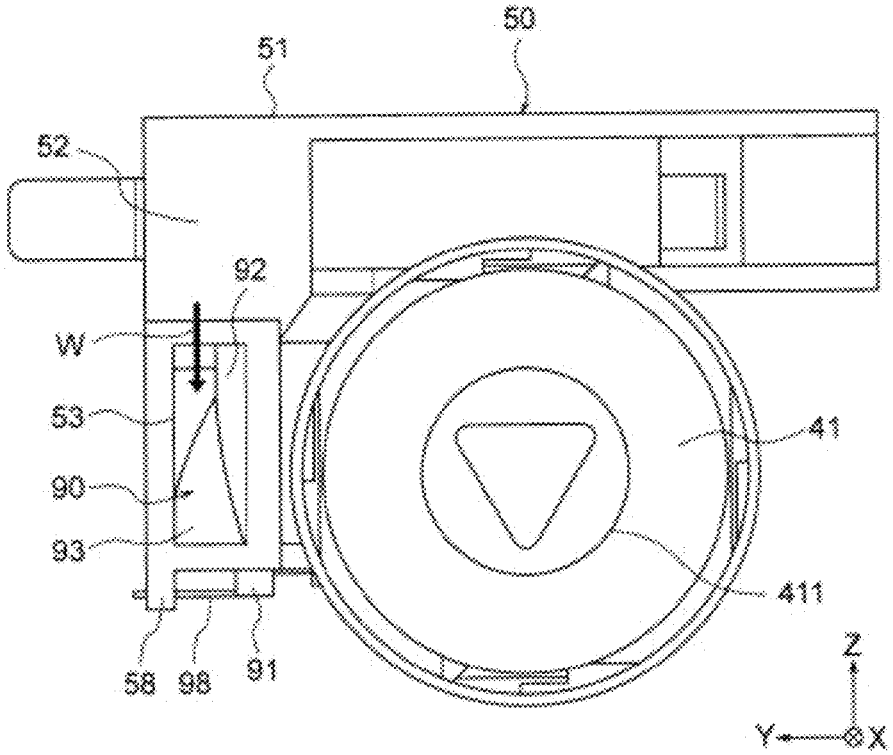
FIG. 19 is a diagram of an air blowing duct, an open/close door, and a development roller coupling of the second embodiment viewed from the process unit side.
Figure 20:
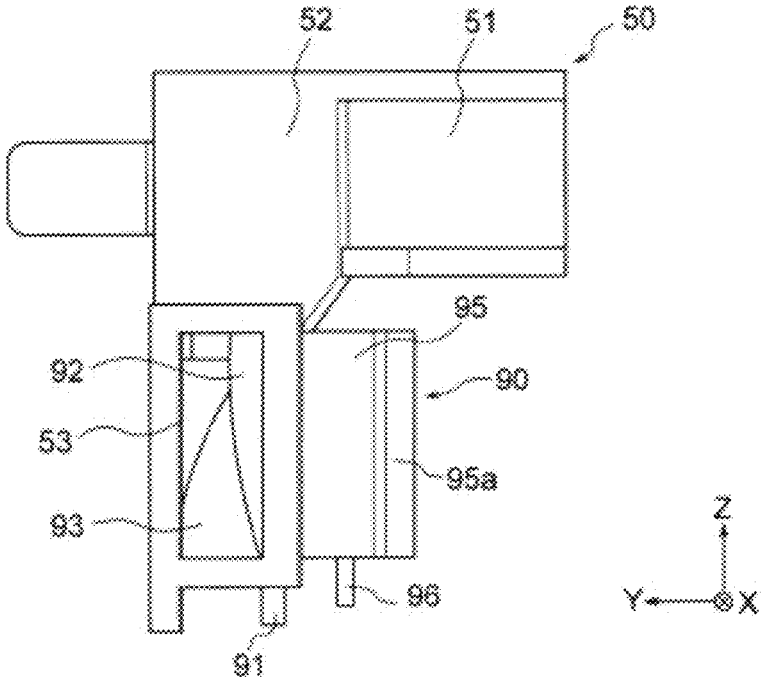
FIG. 20 is a diagram of the air blowing duct and the open/close door of the second embodiment viewed from the process unit side.

FIG. 19 is a diagram viewing an air blowing duct 50, the open/close door 90, and a development roller coupling 41 from the process unit 10 side. FIG. 20 is a diagram viewing the air blowing duct 50 and the open/close door 90 from the process unit 10 side.

The open/close door 90 shown in FIGS. 19 and 20 is installed on all the air blowing ports 53 corresponding to the process units 10K, 10C, 10M, and 10Y, and operates interlocking with the development roller coupling 41. In FIGS. 19 and 20 and below-mentioned FIGS. 21-29, for simplicity the extending direction of the air blowing duct 50 (the unit array direction explained in the first embodiment) is regarded as the Y direction in their explanations.

The open/close door 90 is disposed in the +X direction (that is, the opposite side of the process unit 10) of the development roller coupling 41. In FIGS. 19 and 20, the development roller coupling 41 is in an engagement position where it is engaged with a development roller combining part 33 (FIG. 6). The configuration of the development roller coupling 41 is as explained in the first embodiment.

As shown in FIG. 20, installed on the air blowing port 53 at the tip of a branch duct 52 is the open/close door 90 that opens/closes the air blowing port 53. The open/close door 90 has a rotation shaft 91 having its axis in the Z direction. The rotation shaft 91 is disposed in the −Y direction of the air blowing port 53, and is supported by a supporting part installed on the branch duct 52.

Figure 21:
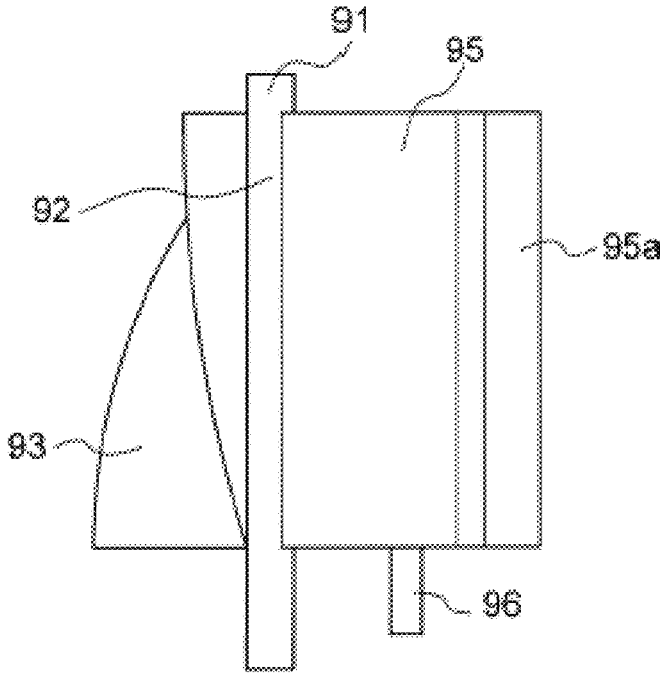
FIG. 21 is a diagram of the open/close door of the second embodiment viewed from the process unit side.
Figure 22A:
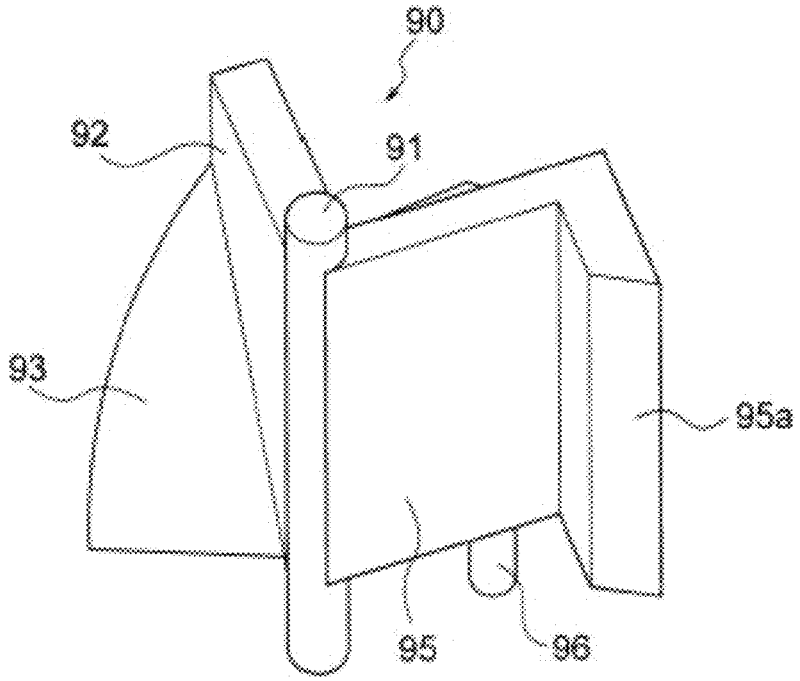
FIGS. 22A and 22B are perspective views showing the open/close door of the second embodiment.
Figure 22B:
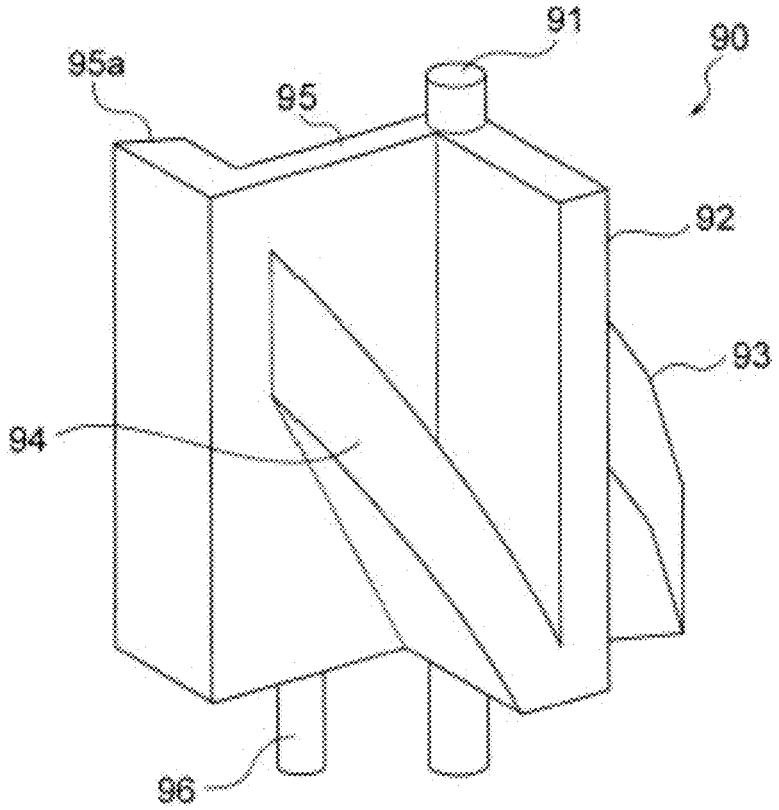
Figure 23:
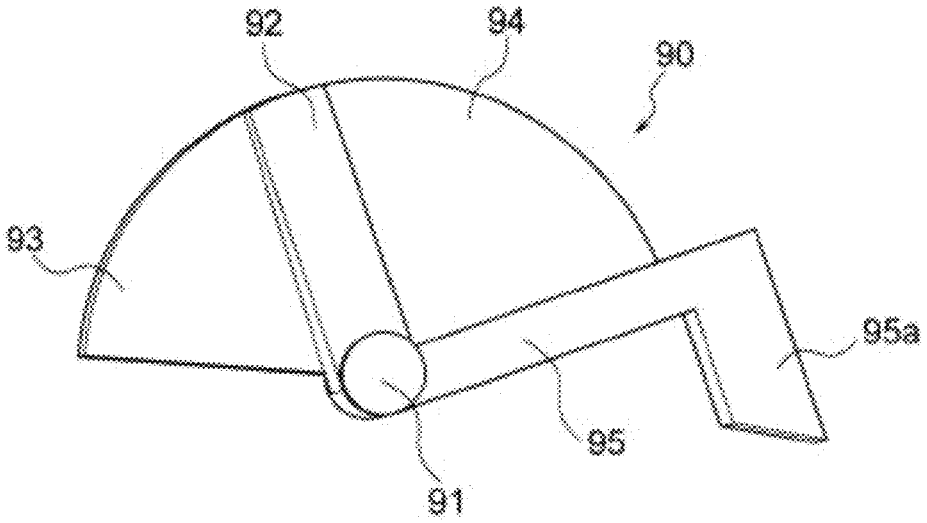
FIG. 23 is a top view showing the open/close door of the second embodiment.

FIG. 21 is a diagram viewing the open/close door 90 from the process unit 10 side. FIGS. 22A and 22B are perspective views showing the open/close door 90. FIG. 23 is a top view showing the open/close door 90. The open/close door 90 has the rotation shaft 91, a first wall part 92 extending radially outwards from the rotation shaft 91, and a second wall part 95 formed at an approximate 90-degree position centering on the rotation shaft 91 relative to the first wall part 92.

The first wall part 92 is a wall part that blocks the air blowing port 53. Formed on the surface of the first wall part 92 is an inclined part 93 that is inclined relative to the Z direction (that is, the axial direction of the rotation shaft 91). The inclined part 93 blocks an opening 52*c* (FIG. 26) of an inclined wall 54 of the branch duct 52 in a state where the first wall part 92 has the air blowing port 53 open. The inclined part 93 directs cooling air (indicated with an arrow W in FIG. 19) flowing up in the −Z direction inside the branch duct 52 toward the +X direction, that is, the process unit 10 side.

Figure 29:
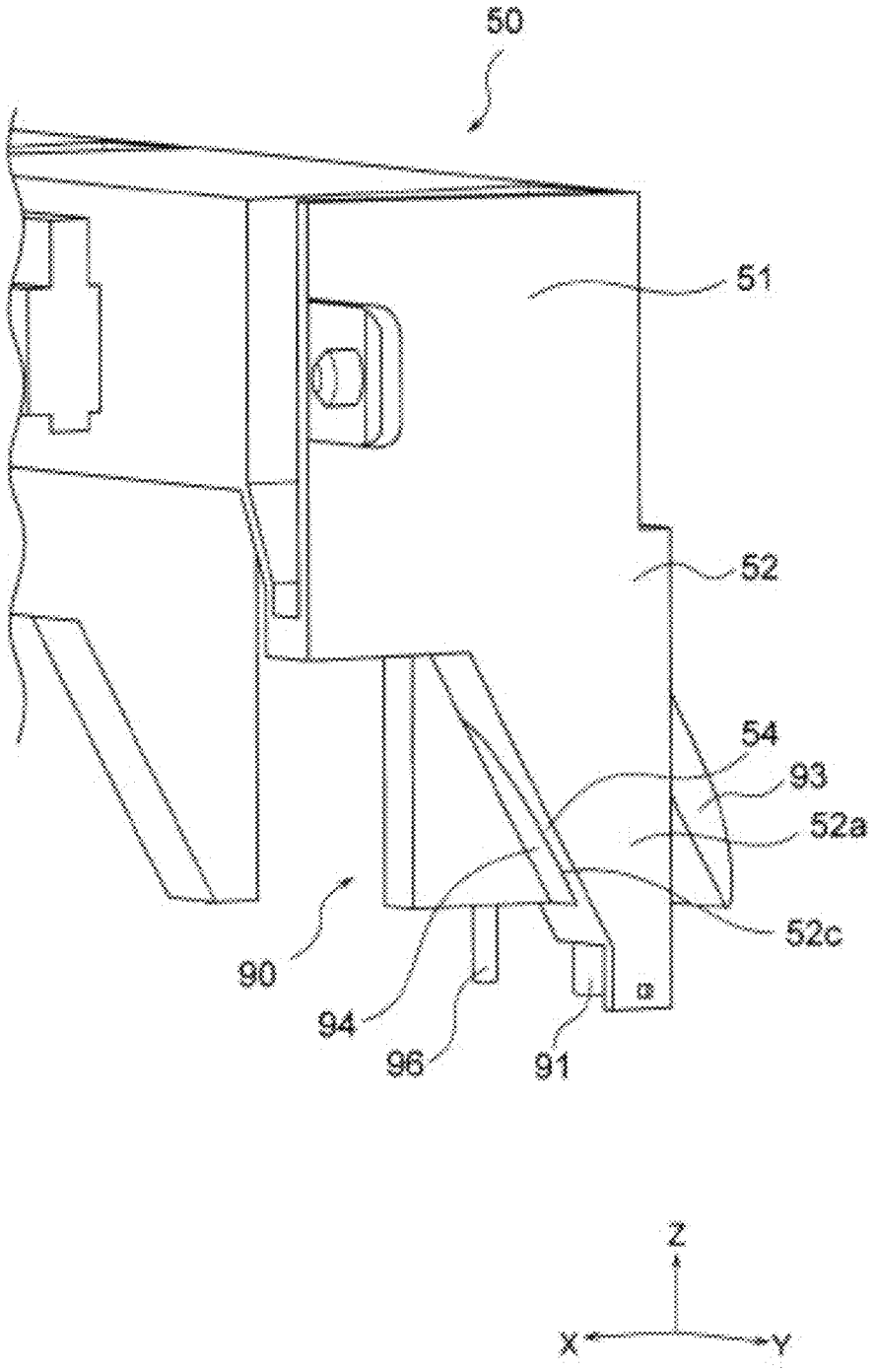
FIG. 29 is a perspective view showing the air blowing duct of the second embodiment.

The second wall part 95 of the open/close door 90 blocks the −Y direction end part 52*b* of the branch duct 52 in a state where the first wall part 92 has the air blowing port 53 closed (FIG. 29). Formed between the first wall part 92 and the second wall part 95 is an inclined part 94 inclined relative to the Z direction. The inclined part 94 blocks the opening 52*c* (FIG. 29) of the inclined wall 54 of the branch duct 52 in a state where the first wall part 92 has the air blowing port 53 closed.

Figure 24:
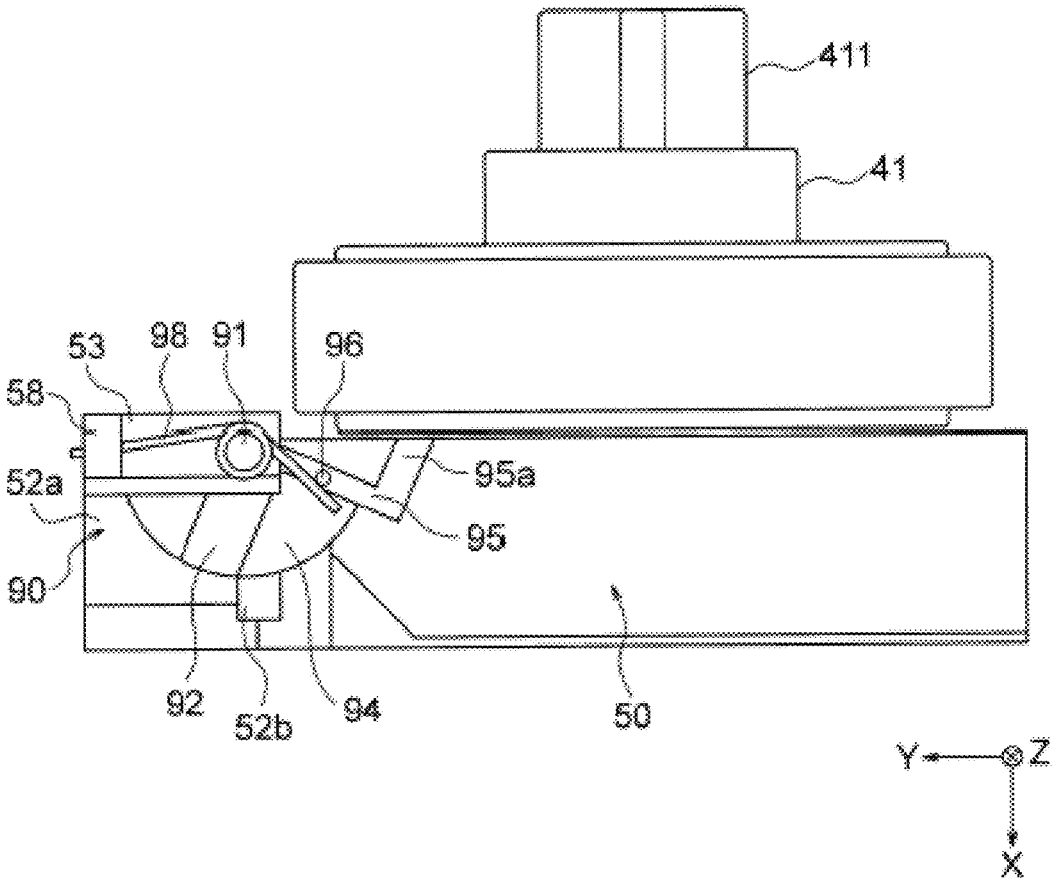
FIG. 24 is a bottom view showing the air blowing duct, the open/close door, and the development roller coupling of the second embodiment.
Figure 25:
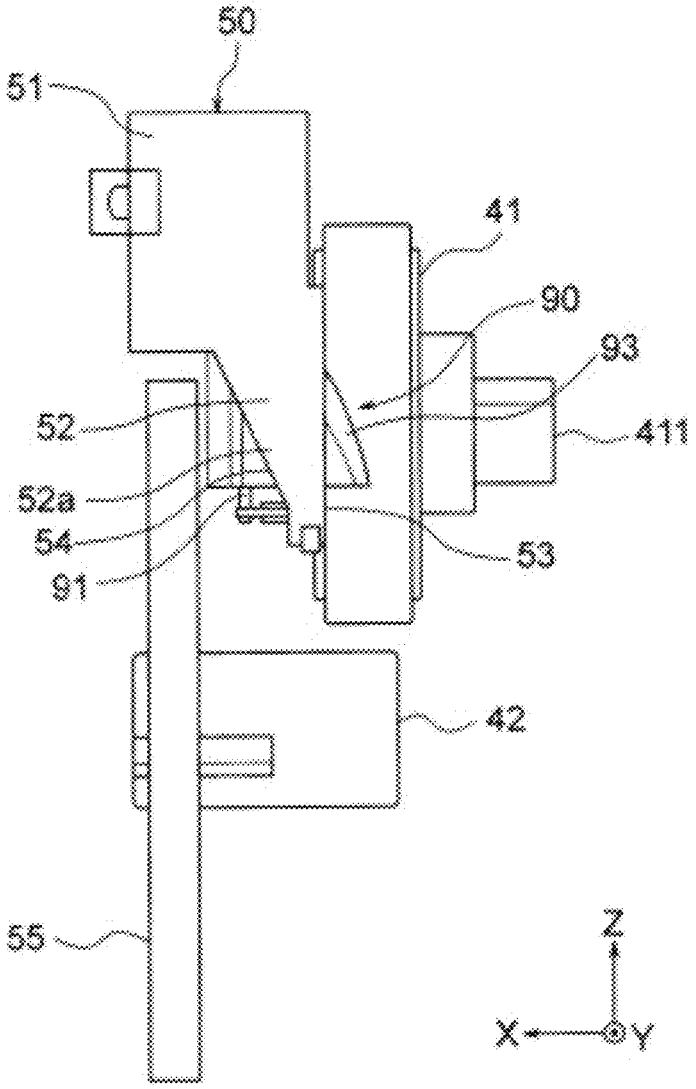
FIG. 25 is a front view showing the air blowing duct, the open/close door, and the development roller coupling of the second embodiment.
Figure 26:
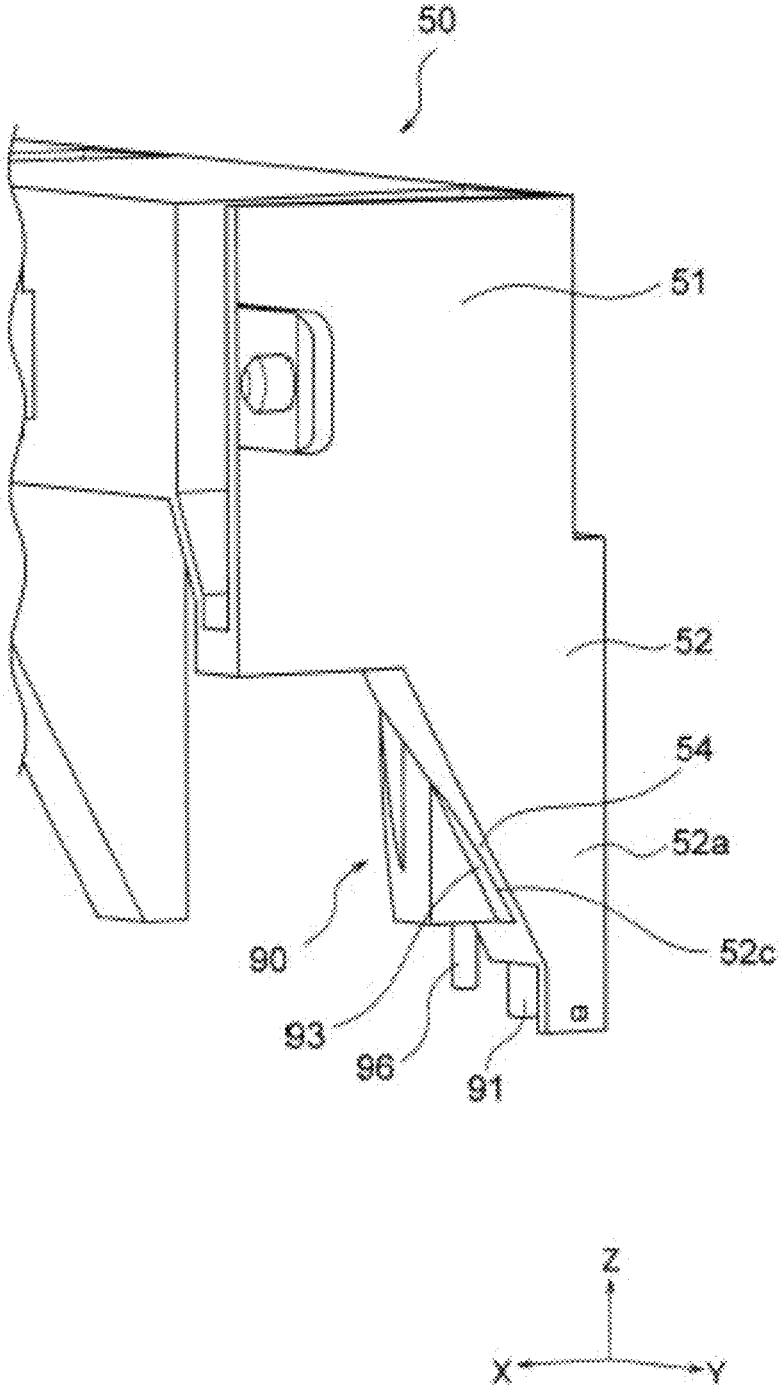
FIG. 26 is a perspective view showing the air blowing duct of the second embodiment.

FIG. 24 is a bottom view showing the air blowing duct 50, the open/close door 90, and the development roller coupling 41. FIG. 25 is a diagram viewing the air blowing duct 50, the open/close door 90, and couplings 41 and 42 from the +Y side. FIG. 26 is a perspective view showing the air blowing duct 50 and the open/close door 90.

In these FIGS. 24-26, the shaft 413 (FIG. 8) of the development roller coupling 41 and the shaft 423 (FIG. 8) of a photosensitive drum coupling 42 are omitted. The development roller coupling 41 is in the engagement position where it is engaged with the development roller combining part 33 (FIG. 6).

As shown in FIG. 24, formed at the tip of the second wall part 95 of the open/close door 90 is an arm part 95*a* contacting the development roller coupling 41. In order to bias the open/close door 90, a torsion spring 98 as a bias member is installed. The center of the torsion spring 98 is wound so as to surround the rotation shaft 91.

One end of the torsion spring 98 contacts a projecting part 58 (FIG. 19) formed protruding on the bottom face of the branch duct 52, and the other end contacts a contact pin 96 formed protruding on the lower end of the second wall part 95 of the open/close door 90. The open/close door 90 is biased by the torsion spring 98 so that the arm part 95*a* contacts the +X side end face of the development roller coupling 41.

The branch duct 52 of the air blowing duct 50 has a wall part 52*a* (FIG. 26) at the +Y direction end part, and the air blowing port 53 at the −X direction end part. As shown in FIG. 26, in order to allow the rotation operation of the open/close door 90, the above-mentioned opening 52*c* is formed on the inclined wall 54 of the branch duct 52. This opening 52*c* is blocked with the above-mentioned inclined part 93 of the open/close door 90.

As shown in the above-mentioned FIGS. 19-20 and 24-26, when the development roller coupling 41 is in the engagement position, the development roller coupling 41 is not biasing the arm part 95*a* of the open/close door 90. In this state, the first wall part 92 of the open/close door 90 is not blocking the air blowing port 53. That is, the air blowing port 53 is open.

Therefore, cooling air sent up through the air blowing duct 50 from the air blowing fan 56 (FIG. 10) is blown via the branch duct 52 to the process unit 10 through the air blowing port 53.

Figure 27:
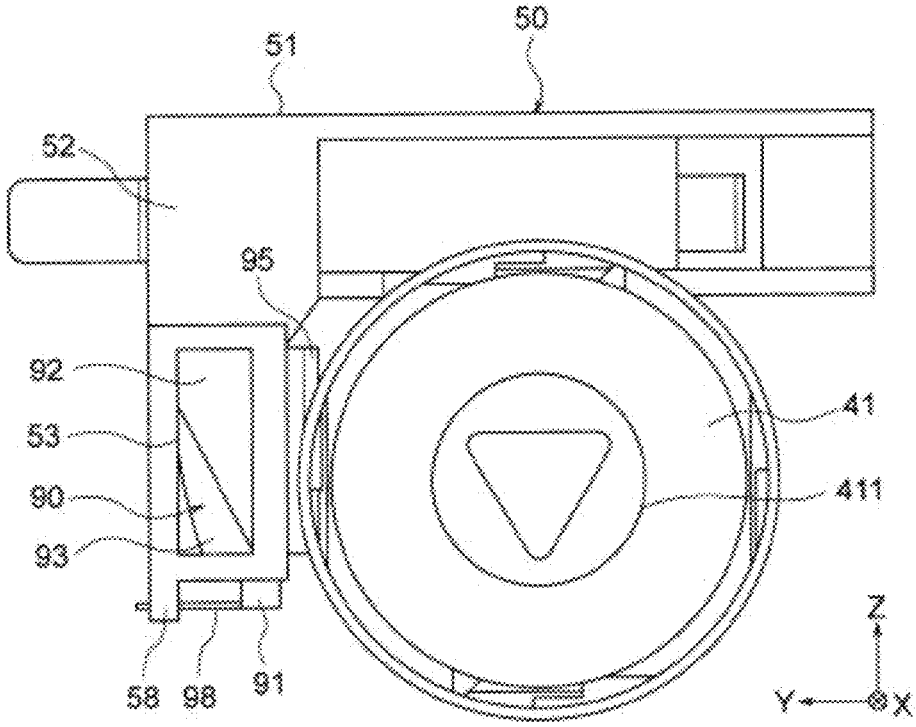
FIG. 27 is a diagram of the air blowing duct, the open/close door, and the development roller coupling of the second embodiment viewed from the process unit side.
Figure 28:
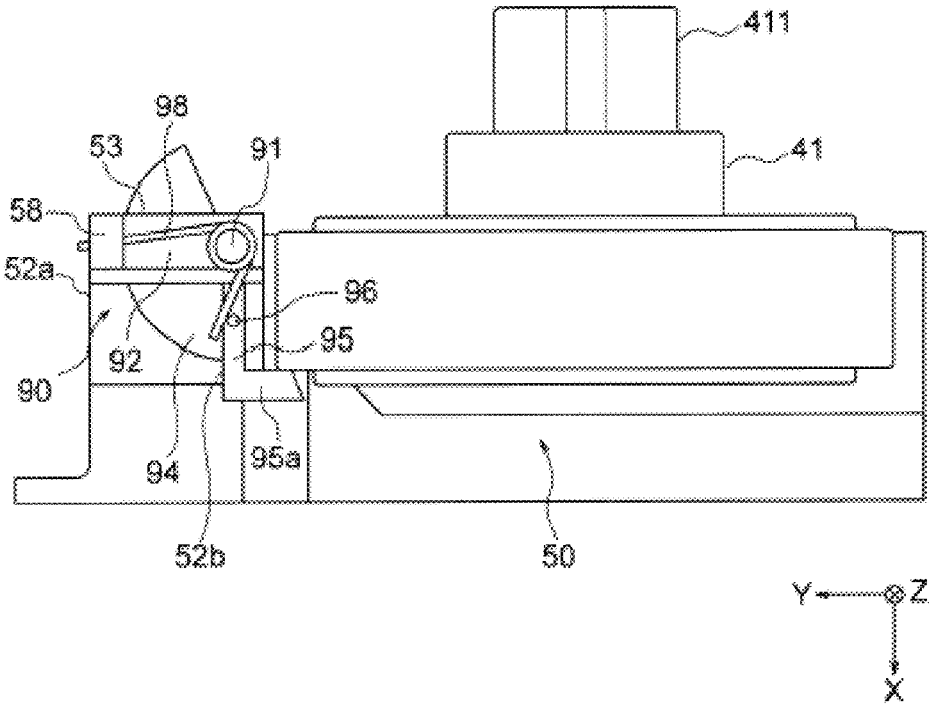
FIG. 28 is a bottom view showing the air blowing duct, the open/close door, and the development roller coupling of the second embodiment.

FIGS. 27 and 28 are diagrams showing a state where the development roller coupling 41 is separated in the +X direction from the development roller combining part 33 (FIG. 6). FIG. 27 is a diagram viewing the air blowing duct 50, the open/close door 90, and the development roller coupling 41 from the process unit 10 side, and FIG. 28 is a bottom view showing the air blowing duct 50, the open/close door 90, and the development roller coupling 41.

Once the development roller coupling 41 separates in the +X direction from the development roller combining part 33 (FIG. 6), the development roller coupling 41 contacts the arm part 95*a* of the open/close door 90, and the open/close door 90 rotates centering on the rotation shaft 91. Thereby, the first wall part 92 of the open/close door 90 closes the air blowing port 53.

Therefore, cooling air sent up through the air blowing duct 50 from the air blowing fan 56 (FIG. 10) is not blown to the process unit 10 through the air blowing port 53.

Also, the −Y direction end part 52*b* (FIG. 28) of the branch duct 52 is blocked with the second wall part 95 of the open/close door 90, and the opening 52*c* of the inclined wall 54 is blocked with the inclined part 94 of the open/close door 90. Therefore, cooling air from the air blowing duct 50 is prevented from leaking to the surroundings.

During color printing, in the same manner as in the first embodiment, the couplings 41 and 42 engage with the development roller combination part 33 and the photosensitive drum combination part 34 (FIG. 6) of all the process units 10K, 10C, 10M, and 10Y. Therefore, the air blowing ports 53 corresponding to the process units 10K, 10C, 10M, and 10Y are all opened by their open/close doors 90, blowing cooling air to all the process units 10K, 10C, 10M, and 10Y.

On the other hand, during monochrome printing, in the same manner as in the first embodiment, the couplings 41 and 42 engage with the development roller combining part 33 and the photosensitive drum combining part 34 (FIG. 6) of the process unit 10K, and the couplings 41 and 42 do not engage with the development roller combining part 33 or the photosensitive drum combining part 34 (FIG. 6) of the process units 10C, 10M, or 10Y.

Therefore, the air blowing port 53 corresponding to the process unit 10K is opened by the open/close door 90, and the air blowing ports 53 corresponding to the process units 10C, 10M, and 10Y are closed by the open/close door 90. Thereby, cooling air is blown concentratedly to the process unit 10K.

In this manner, because the open/close doors 90 open/close the air blowing ports 53 interlocking with the development roller couplings 41 in the second embodiment, cooling air can be blown concentratedly to the process unit 10K during monochrome printing in the same manner as in the first embodiment. Thereby, the process unit 10K can be efficiently cooled, improving image quality.

Also, because the open/close doors 90 open/close the air blowing ports 53 by contacting the development roller couplings 41, there is no need to install independent mechanisms for opening/closing the air blowing ports 53, allowing simplification of the configuration and reduction of the manufacturing cost of the image forming apparatus 1.

Note that although explained here was the configuration where the open/close doors 90 open/close the air blowing ports 53 by contacting the development roller couplings 41, the open/close doors 90 can open/close the air blowing ports 53 by contacting the photosensitive drum couplings 42.

Third Embodiment

Explained in the above-mentioned embodiments were configurations where the air blowing ports 53 were opened/closed interlocking mechanically with switching drive force transmission to the process units 10C, 10M, and 10Y. However, another configuration can be adopted as far as it changes the air flow rate interlocking mechanically with switching between the image forming state and the non-image forming state of the process units 10C, 10M, and 10Y.

In the third embodiment, air blowing ports 53 are opened/closed interlocking mechanically with a lift-up mechanism (separation mechanism) 300 that moves the process units 10C, 10M, and 10Y toward or away from the transfer unit 120. The lift-up mechanism 300 is also called a switching part (or state changing part).

Figure 30A:
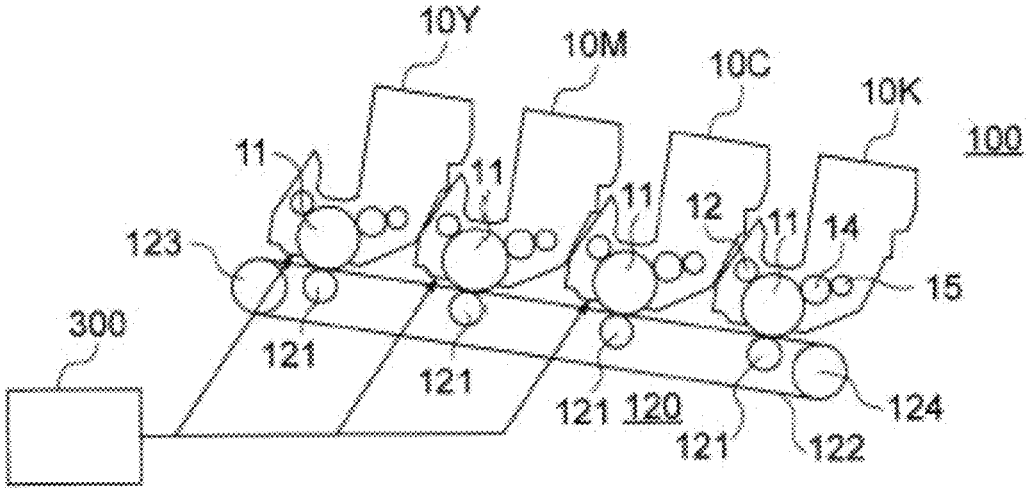
FIGS. 30A and 30B are schematic views for explaining a lift-up mechanism of the third embodiment.
Figure 30B:
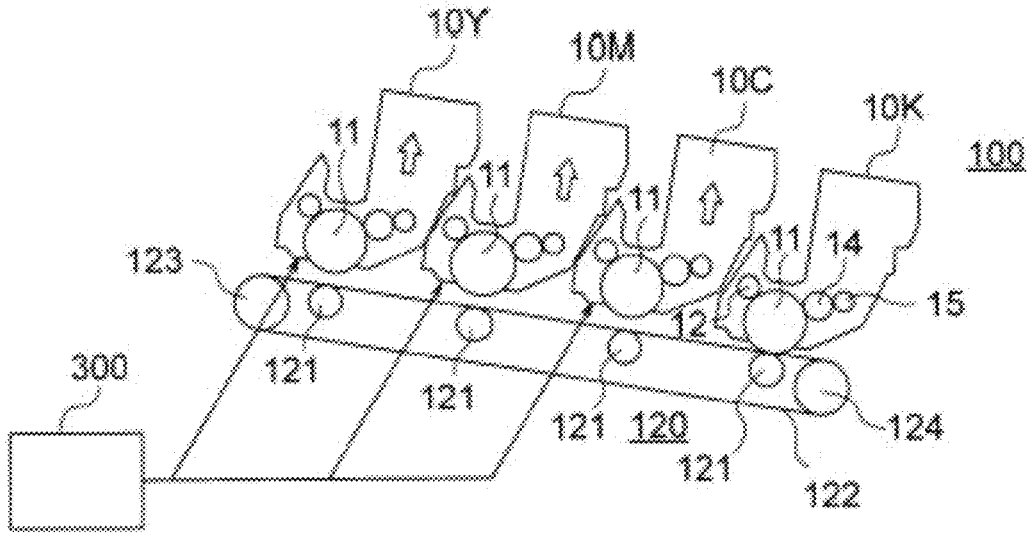

FIGS. 30A and 30B are schematic views for explaining the lift-up mechanism 300. As shown in FIG. 30A, an image forming part 100 has process units 10K, 10C, 10M, and 10Y. During color printing, photosensitive drums 11 of the process units 10K, 10C, 10M, and 10Y are in contact with a transfer belt 122 of a transfer unit 120.

In this manner, the state where the photosensitive drums 11 of the process units 10C, 10M, and 10Y are in contact with the transfer belt 122 of the transfer unit 120 is called an image forming state (first state) of the process units 10C, 10M, and 10Y.

On the other hand, during monochrome printing, as shown in FIG. 30B, the lift-up mechanism 300 lifts up the process units 10C, 10M, and 10Y, thereby separating them from the transfer unit 120.

In this manner, the state where the photosensitive drums 11 of the process units 10C, 10M, and 10Y are separated from the transfer belt 122 of the transfer unit 120 is called a non-image forming state (second state) of the process units 10C, 10M, and 10Y.

In the third embodiment, opening/closing the air blowing ports 53 is performed interlocking with switching between the image forming state and the non-image forming state of the process units 10C, 10M, and 10Y by the lift-up mechanism 300.

Figure 31:
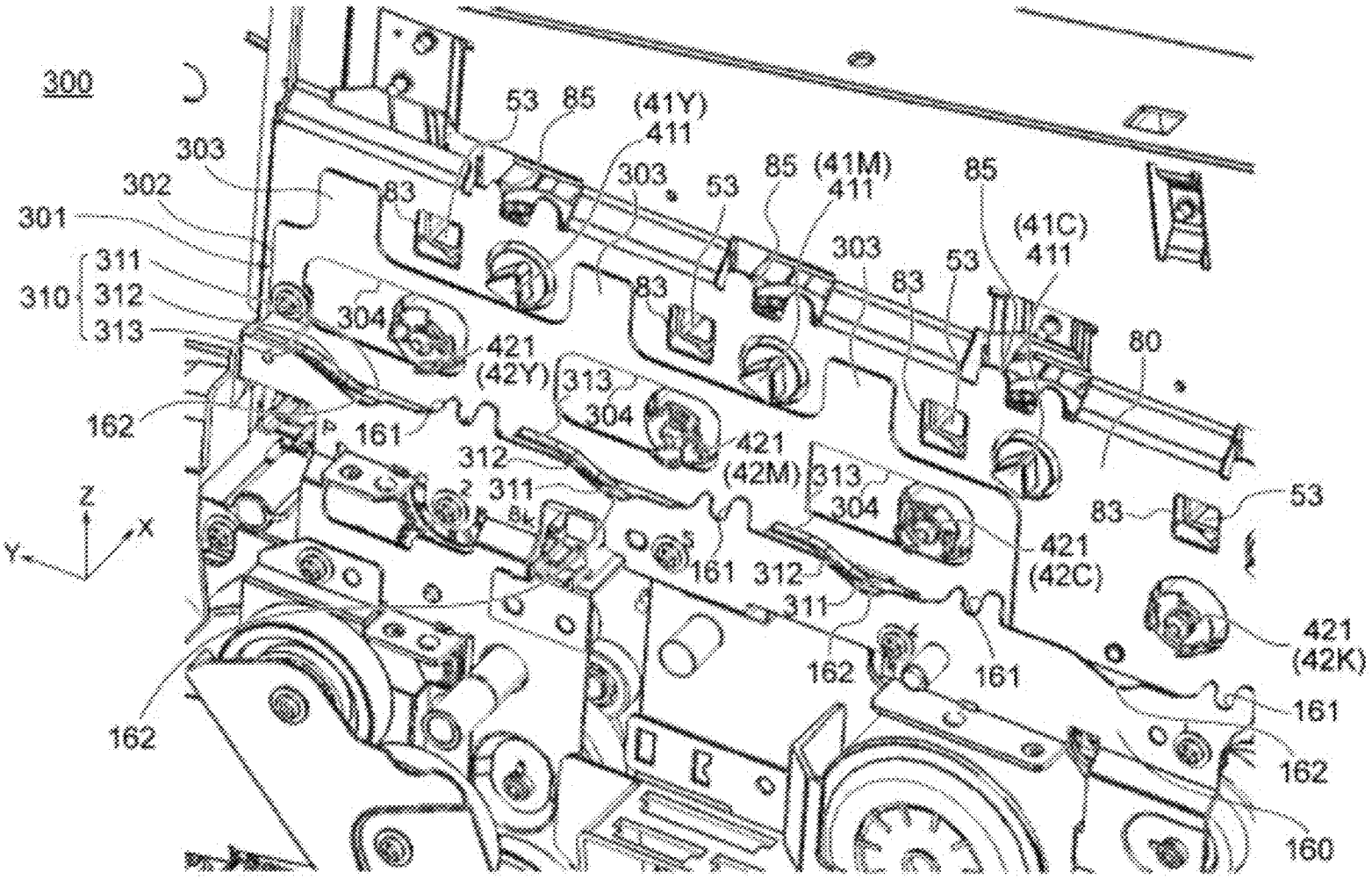
FIG. 31 is a perspective view showing the lift-up mechanism and its surroundings of the third embodiment.

FIG. 31 is a perspective view showing the lift-up mechanism 300 and its surroundings. The lift-up mechanism 300 has a lift-up slider 301 as a moving body that can move in the unit array direction (approximate Y direction) explained in the first embodiment. The lift-up slider 301 is disposed in the −X side (process unit 10 side) of a cover member 80 explained referring to FIG. 15.

The lift-up slider 301 has a side plate part 302 disposed so as to contact the cover member 80, and three ascent/descent parts 310 installed in the −X side of the side plate part 302 for having the process units 10C, 10M, and 10Y ascend/descend.

Each of the ascent/descent parts 310 has a bottom part 311, an inclined part 312, and an apex part 313. The apex part 313 protrudes in the +Z direction relative to the bottom part 311, the inclined part 312 extends so as to connect the bottom part 311 and the apex part 313. The bottom part 311, the inclined part 312, and the apex part 313 are arranged in a row in this order in the +Y direction.

Each of the ascent/descent parts 310 contacts a contact face 38 installed on the bottom face of a side frame 31 (FIG. 6) of each of the process units 10C, 10M, and 10Y. Although the contact face 38 is a curved face in an arch shape for example, it is not limited to this.

When the lift-up slider 301 is in a reference position (first position) shown in FIG. 31, each of the contact faces 38 of the process units 10C, 10M, and 10Y opposes the bottom part 311. In this state, the process units 10C, 10M, and 10Y are each in a position (that is, a transfer position) where the photosensitive drums 11 contact the transfer belt 122 as shown in FIG. 30A.

Figure 36:
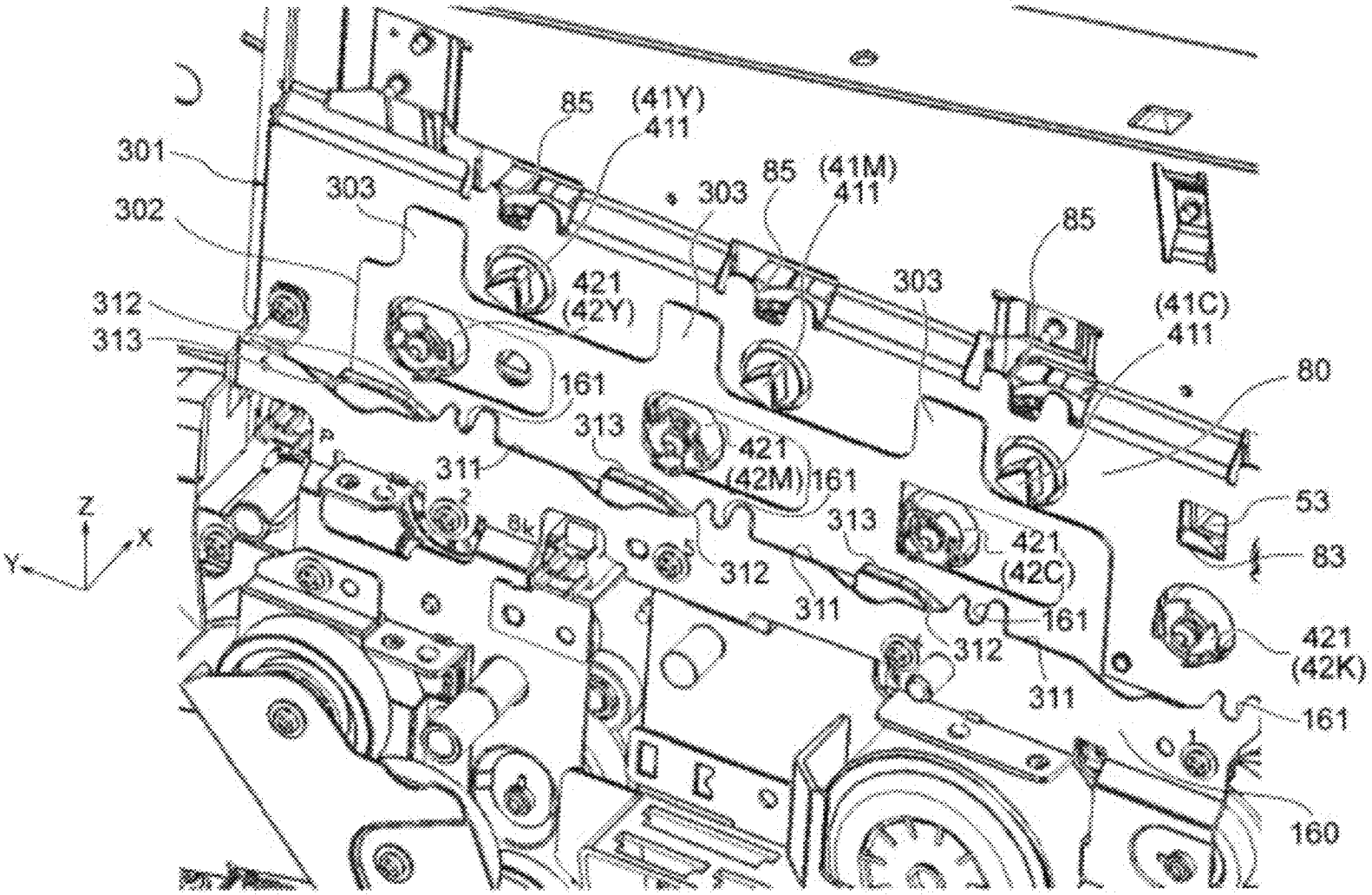
FIG. 36 is a perspective view showing the lift-up mechanism and its surroundings of the third embodiment.

On the other hand, once the lift-up slider 301 moves in the −Y direction and reaches a lift-up position (second position: FIG. 36), each of the contact faces 38 of the process units 10C, 10M, and 10Y contacts the apex part 313 and is pushed up in the +Z direction. As a result, as shown in FIG. 30B, each of the photosensitive drums 11 of the process units 10C, 10M, and 10Y reaches a position (that is, a separated position) separated from the transfer belt 122 in the +Z direction.

The side plate part 302 of the lift-up slider 301 has three openings 304 through which the photosensitive drum couplings 42C, 42M, and 42Y corresponding to the process units 10C, 10M, and 10Y pass. The openings 304 are long holes elongated in the unit array direction (approximate Y direction).

Formed on the upper side (+Z side) of the side plate part 302 of the lift-up slider 301 are closing parts (cover parts) that close the three air blowing ports 53 corresponding to the process units 10C, 10M, and 10Y.

When the lift-up slider 301 is in the reference position (FIG. 31), none of the three closing parts 303 is in a position overlapping with any of the air blowing ports 53, thereby the air blowing ports 53 are open. On the other hand, once the lift-up slider 301 moves in the −Y direction and reaches the lift-up position (FIG. 36), the three closing parts 303 close the air blowing ports 53, respectively.

Figure 32:
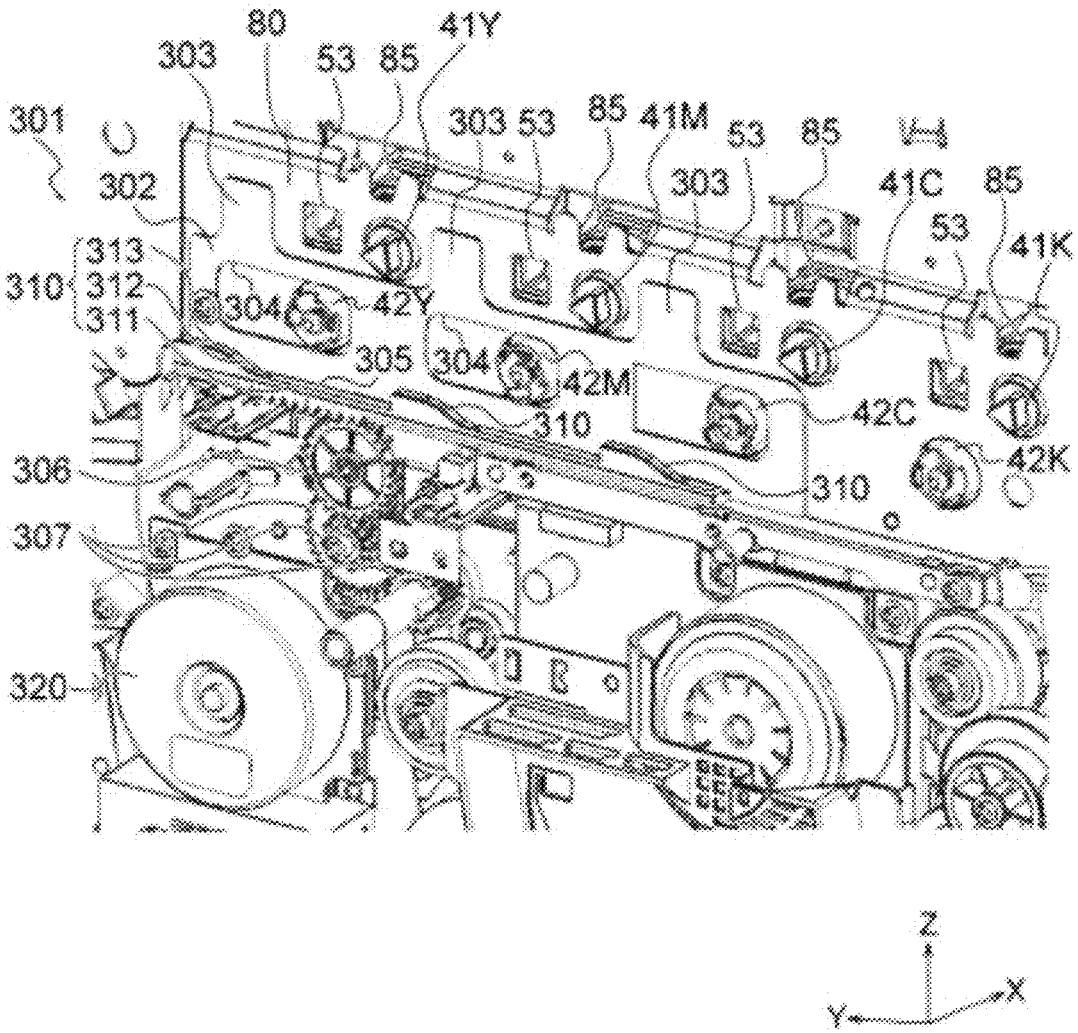
FIG. 32 is a perspective view showing a lift-up slider and its surroundings of the third embodiment.

FIG. 32 is a diagram showing the lift-up slider 301 and its surroundings after removing a supporting plate 160 mentioned below. The lift-up slider 301 has a rack gear 305 as a drive force transmitting part on the bottom face (−Z direction face) of the ascent/descent parts 310.

Installed in a position engaging with the rack gear part 305 is a pinion 306. The pinion 306 is connected to an ascent/descent motor 320 that is a drive source through a gear array 307 (including a deceleration gear, an idle gear, etc.). The drive force of the ascent/descent motor 320 is transmitted to the rack gear 305 through the gear array 307 and the pinion 306, thereby the lift-up slider 301 moves straight in the unit array direction (approximate Y direction).

Returning to FIG. 31, disposed in the −X side (process unit 10 side) of the lift-up slider 301 is the supporting plate 160 that is parallel to the cover member 80. The lift-up slider 301 is held between the cover member 80 and the supporting plate 160.

The supporting plate 160 has four groove parts 161 each of which engages with a positioning part 36 (FIG. 6) installed on the side frame 31 of each of the process units 10. The groove parts 161 extend in the approximate Z direction with the upper ends (+Z direction end parts) open.

The cover member 80 has four groove parts 85 each of which engages with a positioning part 37 (FIG. 6) installed on the side frame 31 of each of the process units 10. The groove parts 85 extend in the approximate Z direction with the upper ends (+Z direction end parts) open.

Figure 33:
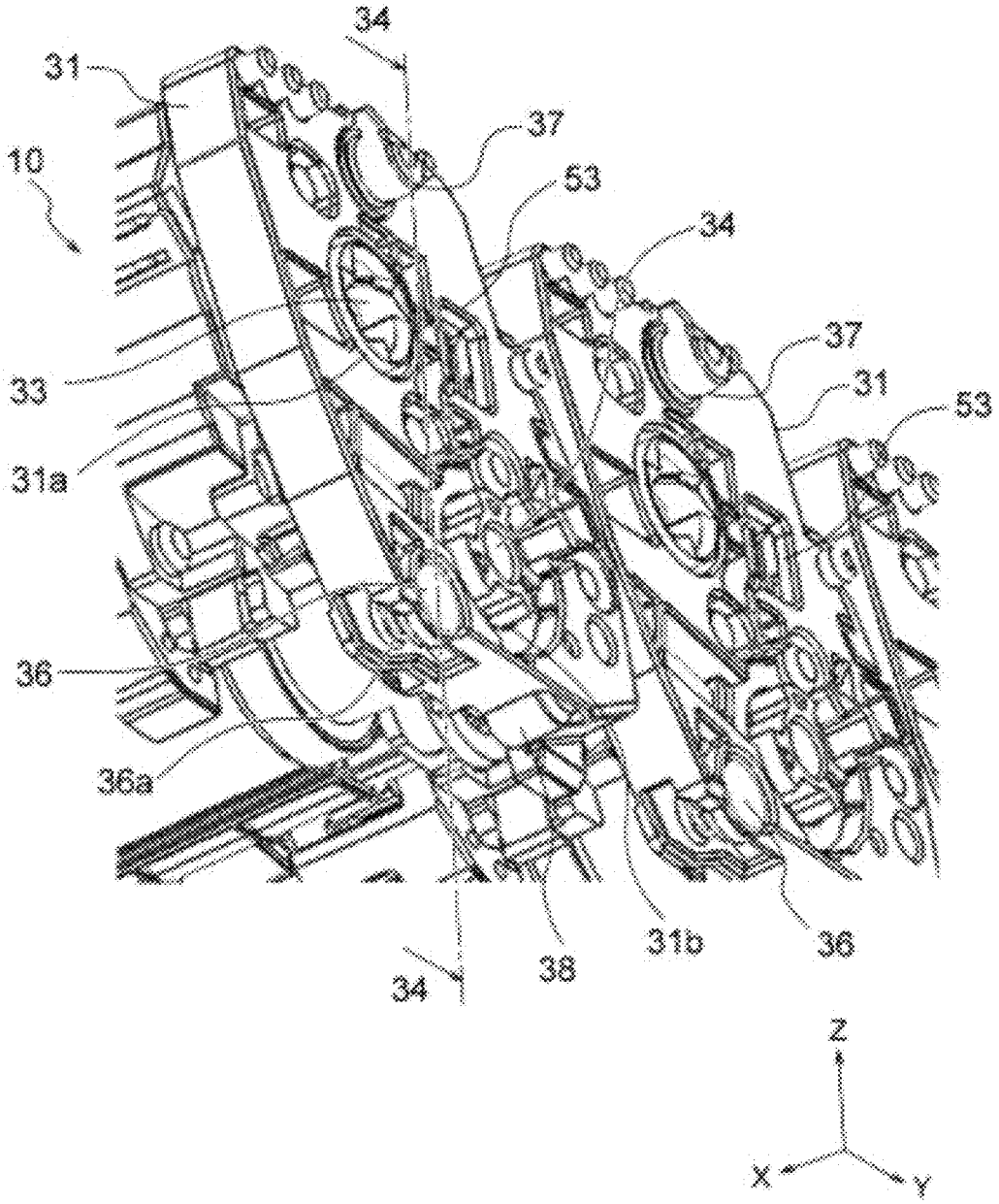
FIG. 33 is a perspective view showing side frames of process units of the third embodiment.
Figure 34:
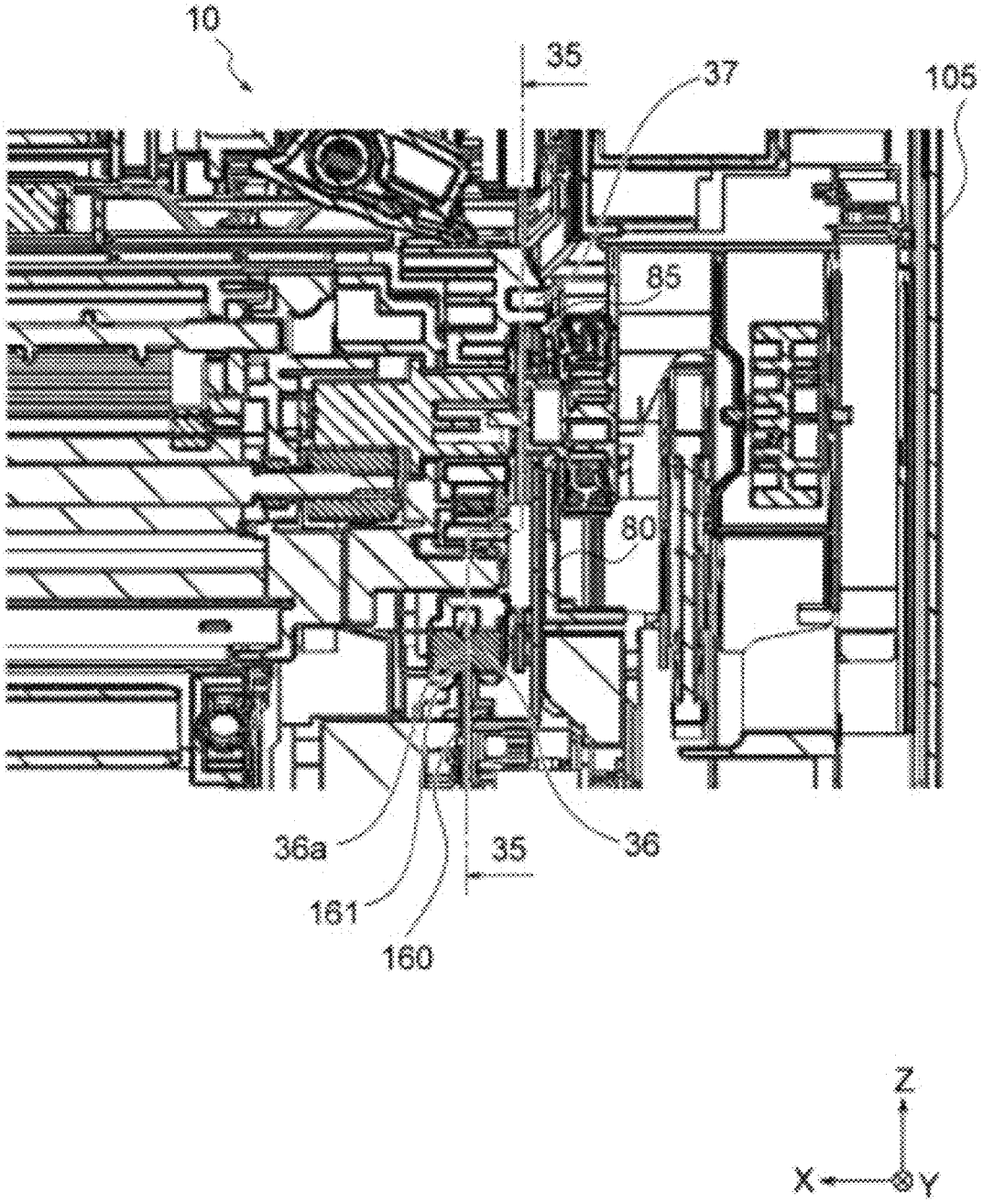
FIG. 34 is a cross-sectional view along a line 34-34 in FIG. 33.
Figure 35:
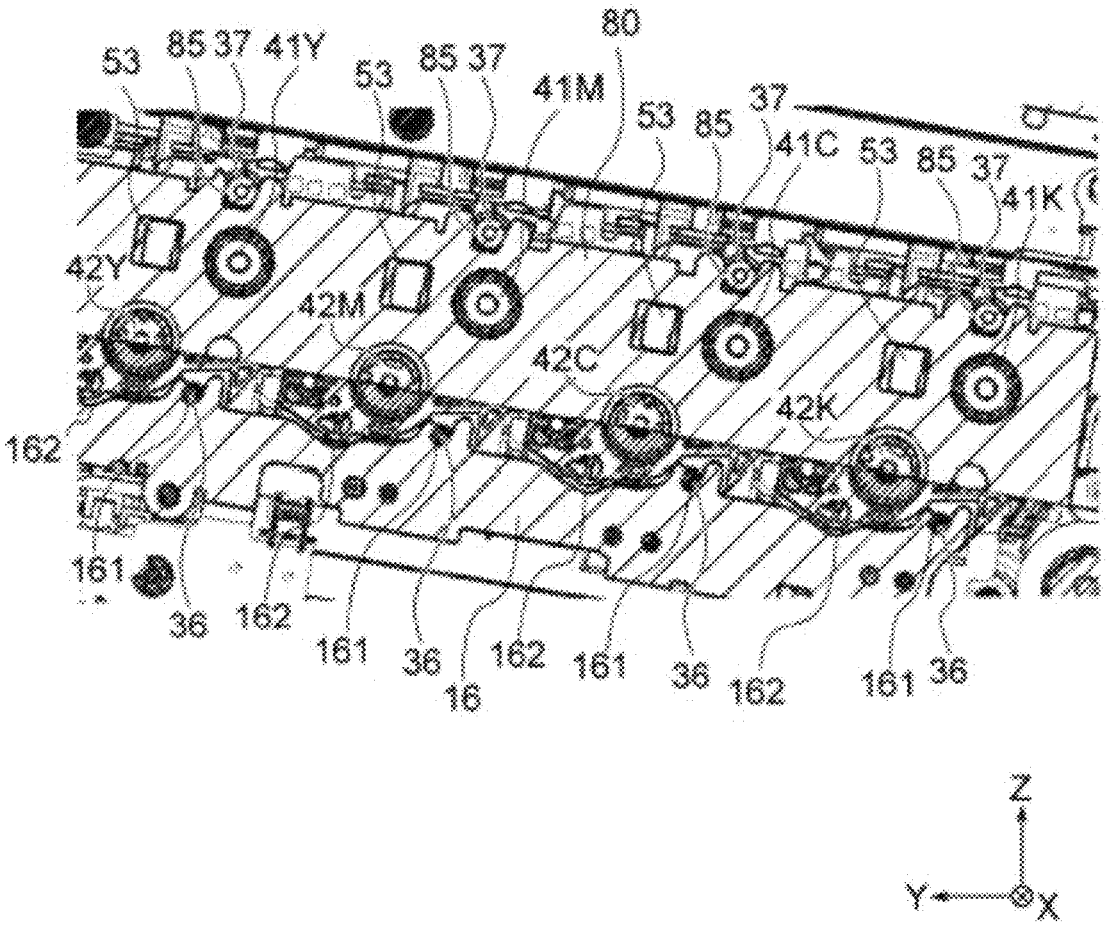
FIG. 35 is a cross-sectional view along a line 35-35 in FIG. 34.

FIG. 33 is a perspective view showing the side frames 31. FIG. 34 is a cross-sectional view along a line segment 34-34 shown in FIG. 33. FIG. 35 is a cross-sectional view along a line segment 35-35 shown in FIG. 34.

As shown in FIG. 33, attached to the lower end (−Z direction end part) of each of the side frames 31 is the positioning part 36. The positioning part 36 has a shaft part 36*a* of a small diameter inside along the X-direction of the side frame 31. The shaft parts 36*a* of the positioning parts 36 engage with the groove parts 161 of the supporting plate 160 as shown in FIGS. 34 and 35.

Also, attached to the upper end (+Z direction end part) of each of the side frames 31 is the positioning part 37. The positioning part 37 is approximately a cylindrical part protruding in the +X direction from the side frame 31. The positioning parts 37 engage with the groove parts 85 of the cover member 80 as shown in FIGS. 34 and 35.

By the positioning parts 36 and 37 of each of the side frames 31 engaging with the groove parts 161 of the supporting plate 160 and the groove parts 85 of the cover member 80, respectively, attitudes of the process units 10C, 10M, and 10Y are maintained during the lift-up operation.

Note that as shown in FIG. 31, in positions corresponding to the three bottom parts 311 of the lift-up slider 301 that is in the reference position, the supporting plate 160 has recessed parts 162 that are higher (that is, in the Z direction position) than the bottom parts 311. When the contact faces 38 (FIG. 33) of the process units 10C, 10M, and 10Y oppose the bottom parts 311 of the lift-up slider 301, the contact faces 38 are held contacting the recessed parts 162 of the supporting plate 160.

FIG. 36 is a perspective view showing a state where the lift-up slider 301 has moved in the −Y direction from the reference position (FIG. 31) and reached the lift-up position. In FIG. 36, the apex parts 313 of the lift-up slider 301 contact and bias in the +Z direction the contact faces 38 (FIG. 33) of the process units 10C, 10M, and 10Y.

Thereby, the process units 10C, 10M, and 10Y are lifted in the +Z direction, and as shown in FIG. 30B, the photosensitive drums 11 of the process units 10C, 10M, and 10Y separate from the transfer belt 122.

Also, once the lift-up slider 301 moves in the −Y direction, the closing parts 303 of the lift-up slider 301 close the air blowing ports 53 corresponding to the process units 10C, 10M, and 10Y. Because the air blowing port 53 corresponding to the process unit 10K is open, air flowing through the air blowing duct 50 is blown concentratedly to the process unit 10K.

Note that the configuration to switch drive force transmission to the process units 10K, 10C, 10M, and 10Y is about the same as the configuration explained in the first embodiment. Because the first slider 60 and the second slider 70 (FIG. 12) are disposed in the +X direction of the cover member 80 in the same manner as in the first embodiment, they are hidden behind the cover member 80 in FIGS. 31, 32, 35, and 36.

Also, as explained in the second embodiment as well, the openings 71 (FIG. 12) of the second slider 70 are longer than those in the first embodiment, and configured so that the second slider 70 does not close the air blowing ports 53 even if the second slider 70 moved in the unit array direction (approximate Y direction).

Figure 37:
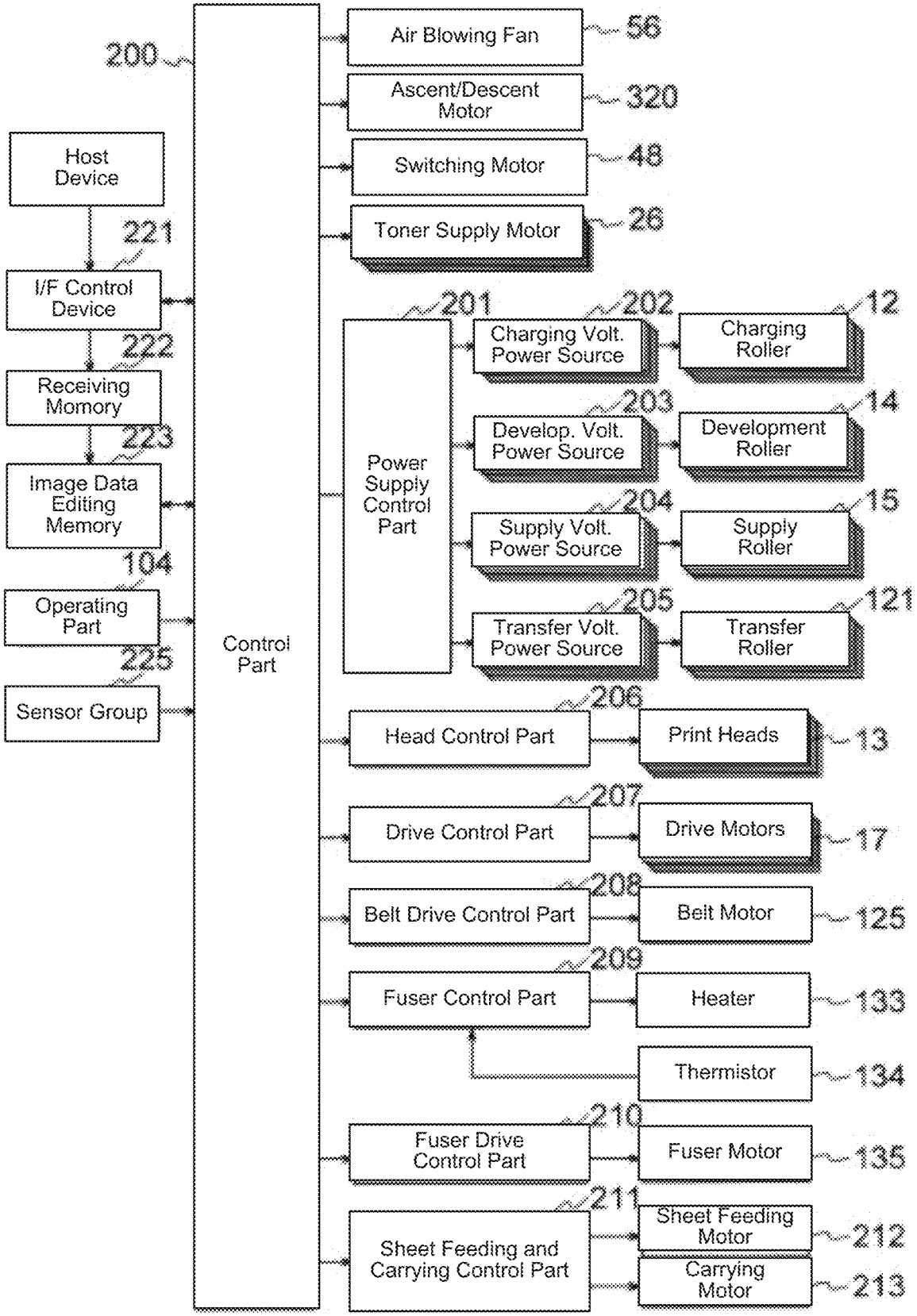
FIG. 37 is a block diagram showing the control system of an image forming apparatus of the third embodiment.

FIG. 37 is a block diagram showing the control system of an image forming apparatus of the third embodiment. As shown in FIG. 37, in the control system of the image forming apparatus of the third embodiment, an ascent/descent motor (a separation mechanism motor) 320 for driving the lift-up slider 301 (lift-up mechanism 300) is added to the control system (FIG. 18) of the image forming apparatus 1 of the first embodiment.

When performing monochrome printing, a control device 200 drives a switching motor 48 to cut off drive force transmission to the process units 10C, 10M, and 10Y, and afterwards drives the ascent/descent motor 320 to move the process units 10C, 10M, and 10Y from the transfer positions to the separated positions. The remaining configuration of the third embodiment is as explained in the first embodiment.

The operations of the image forming apparatus of the third embodiment are as follows. During color printing, the lift-up slider 301 is in the reference position (FIG. 31). When the lift-up slider 301 is in the reference position, the bottom parts 311 of the lift-up slider 301 oppose the contact faces 38 (FIG. 33) of the process units 10C, 10M, 10*y*.

Therefore, the process units 10K, 10C, 10M, and 10Y are in the transfer positions (that is, the positions where the photosensitive drums 11 contact with the transfer belt 122). In other words, all the process units 10K, 10C, 10M, and 10Y are in the image forming state.

Also, at this time, the three closing parts 303 of the lift-up slider 301 are not in positions closing the air blowing ports 53. Therefore, cooling air is blowing to the process units 10K, 10C, 10M, and 10Y through the four air blowing ports 53 of the air blowing duct 50.

Both the first slider 60 and the second slider 70 are in positions shown in FIG. 12, and as explained in the first embodiment, drive forces are transmitted to all the development rollers 14 and the photosensitive drums 11 of the process units 10K, 10C, 10M, and 10Y. In this state, the medium P is fed from a medium supply part 110 (FIG. 2), forming a color image as explained in the first embodiment.

On the other hand, during monochrome printing, the control device 200 drives the switching motor 48 to move the second slider 70 to a cut-off position shown in FIG. 14C. Thereby, the development roller couplings 41C, 41M, and 41Y, and the photosensitive drum couplings 42C, 42M, and 42Y separate from the development roller combining parts 33 and the photosensitive drum combining parts 34 (FIG. 33) of the process units 10C, 10M, and 10Y.

Next, the control device 200 drives the ascent/descent motor 320 to move the lift-up slider 301 from the reference position (FIG. 31) to the lift-up position (FIG. 36). Thereby, the apex parts 313 of the lift-up slider 301 contact the contact faces 38 (FIG. 33) of the process units 10C, 10M, and 10Y, and lift up the process units 10C, 10M, and 10Y in the +Z direction.

Therefore, the process units 10C, 10M, and 10Y are in the separated positions (that is, the positions where the photosensitive drums 11 are separated from the transfer belt 122), and only the process unit 10K is in the transfer position. In other words, the process units 10C, 10M, and 10Y are switched from the image forming state to the non-image forming state.

Also, at this time, the three closing parts 303 of the lift-up slider 301 close the air blowing ports 53 as shown in FIG. 36. Thereby, the air blowing ports 53 corresponding to the process units 10C, 10M, and 10Y are closed, and only the air blowing port 53 corresponding to the process unit 10K is open. Therefore, cooling air from the air blowing duct 50 is blown concentratedly to the process unit 10K. In this state, the medium P is supplied from the medium supply part 110 (FIG. 2), forming a monochrome image as explained in the first embodiment.

In this manner, in the third embodiment, the air blowing ports 53 of the process units 10C, 10M, and 10Y are opened/closed interlocking with the ascent/descent of the process units 10C, 10M, and 10Y by the lift-up mechanism 300. Therefore, when the process units 10C, 10M, and 10Y are not used (during monochrome printing), these air blowing ports 53 can be closed, blowing cooling air concentratedly to the process unit 10K. Thereby, the process unit 10K can be efficiently cooled, improving image quality.

Also, because the air blowing ports 53 of the process units 10C, 10M, and 10Y are opened/closed by the movement of the lift-up slider 301, these air blowing ports 53 can be opened/closed according to changes in the states of the process units 10C, 10M, and 10Y with a simple configuration.

Also, because the lift-up slider 301 has the three closing parts 303 that open/close the air blowing ports 53 of the process units 10C, 10M, and 10Y, there is no need to install independent shutters, allowing the number of parts to be reduced.

Also, bymoving the process units 10C, 10M, and 10Y to the separated positions by the lift-up mechanism 300 during monochrome printing, unnecessary sliding of parts such as the photosensitive drums 11 and the transfer belt 122 can be omitted, suppressing their frictions.

Modification Example

Figure 38:
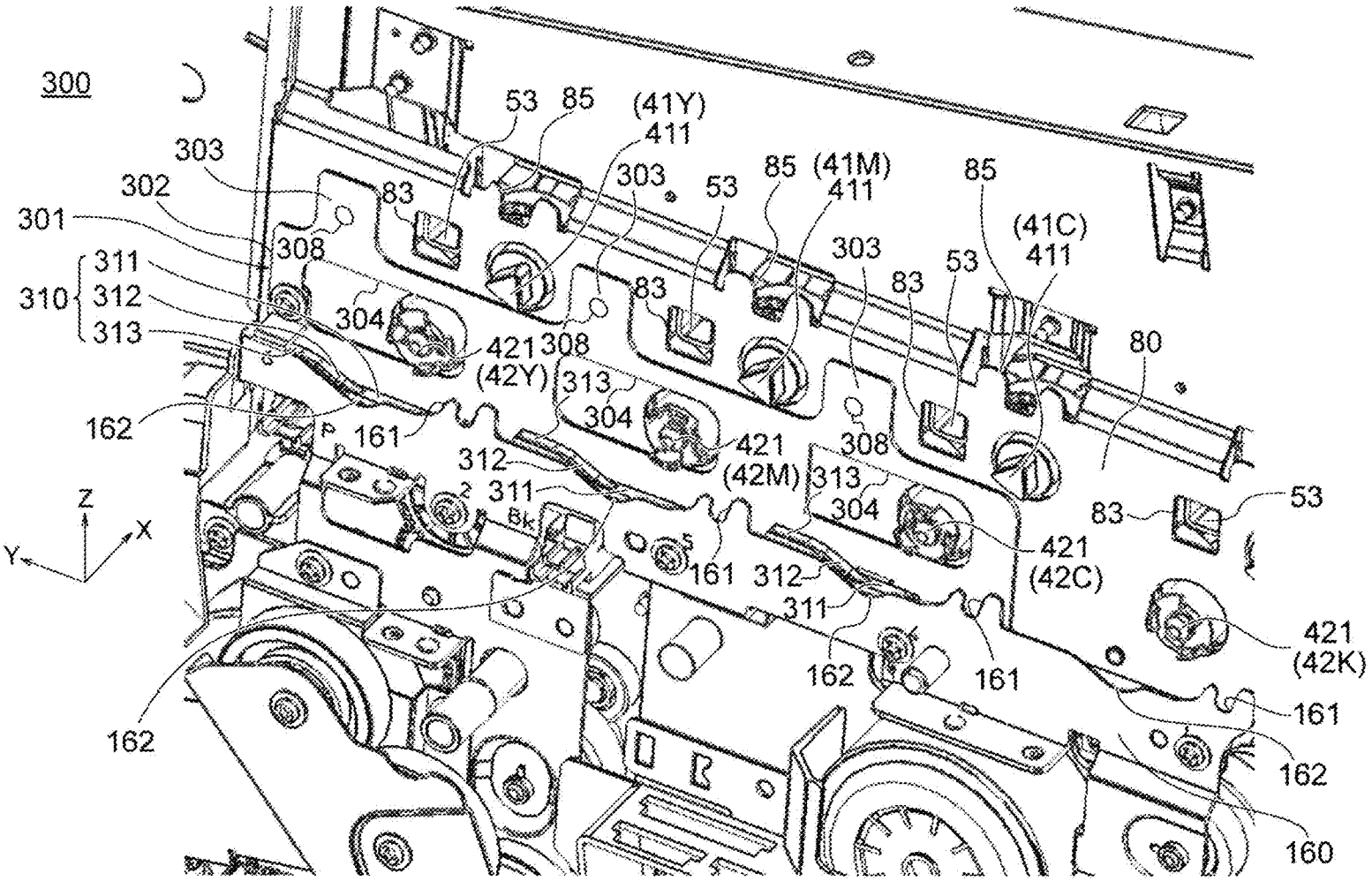
FIG. 38 is a perspective view showing a lift-up mechanism and its surroundings of a modification example of the third embodiment.

Next, explained is a modification example of the third embodiment. FIG. 38 is a perspective view showing a lift-up slider 301 and its surroundings in the modification example of the third embodiment. The lift-up slider 301 of the modification example has a hole part 308 that allows cooling air to pass through on each of three closing parts 303 corresponding to air blowing ports 53 of process units 10C, 10M, and 10*y*.

The hole parts 308 are parts that allow cooling air to pass through when the closing parts 303 are blocking the air blowing ports 53. Although the shape of the hole parts 308 is circular in FIG. 38, they can be in another shape.

In the image forming apparatus of the modification example, during monochrome printing, the lift-up slider 301 moves in the −Y direction from the reference position shown in FIG. 38, and reaches the lift-up position shown in FIG. 36. Thereby, the closing parts 303 of the lift-up slider 301 nearly block the air blowing ports 53 of the process units 10C, 10M, and 10Y.

However, because each of the closing parts 303 has the hole part 308, the air blowing port 53 of each of the process units 10C, 10M, and 10Y is not completely closed. In other words, the air blowing port 53 of each of the process units 10C, 10M, and 10Y is partially closed. That is, during monochrome printing, a small amount of cooling air is blown to each of the process units 10C, 10M, and 10Y through the air blowing port 53 and the hole part 308.

During monochrome printing, the air flow rates to the process units 10C, 10M, and 10Y become lower than those during color printing. Therefore, while cooling air is blown concentratedly to the process unit 10K, small amounts of cooling air are also blown to the process units 10C, 10M, and 10*y*.

During monochrome printing, although the photosensitive drums 11, the development rollers 14, etc. of the process units 10C, 10M, and 10Y do not rotate, heat during color printing may still remain. By blowing small amounts of cooling air to the process units 10C, 10M, and 10Y, the cooling effects can be enhanced.

Except that the hole parts 308 are formed on the closing parts 303 of the lift-up slider 301, the configuration of the image forming apparatus of the modification example is the same as that of the image forming apparatus in the third embodiment.

Also, except that a small amount of cooling air is blown to each of the process units 10C, 10M, and 10Y during monochrome printing, the operations of the image forming apparatus of the modification example are the same as those of the image forming apparatus in the third embodiment.

As explained above, according to this modification example, by decreasing the air flow rates to the process units 10C, 10M, and 10Y during monochrome printing, the process unit 10K can be efficiently cooled, and the process units 10C, 10M, and 10Y can be cooled with small amounts of cooling air.

Note that although the hole parts 308 were installed on the closing parts 303 of the lift-up slider 301 here, any configuration can be adopted as far as it reduces the air flow rates to the process units 10C, 10M, and 10Y during monochrome printing. For example, adoptable is a configuration that each of the closing parts 303 of the lift-up slider 301 closes part (e.g., a half) of each of the air blowing ports 53 during monochrome printing.

Also, the configuration that reduces the air flow rates to the process units 10C, 10M, and 10Y during monochrome printing can be applied to the image forming apparatuses of the first embodiment and the second embodiment mentioned above. In this case, for example, similar hole parts to the hole parts 308 of the modification example can be installed on the second slider 70 shown in FIG. 12. Also, a similar hole part to the hole part 308 of the modification example can be installed on the first wall part 92 of the open/close door 90 shown in FIG. 22A.

Note that although adopted in the first-third embodiments mentioned above were configurations where the air blowing ports 53 of the air blowing duct 50 were opened/closed (or the aperture areas were changed), instead of being limited to the air blowing ports 53, any configuration can be adopted as far as it can change the air flow rates of cooling air blown to the process units 10C, 10M, and 10Y from the air blowing duct 50.

Also, although the air blowing ports 53 that were part of the air blowing duct 50 were opened/closed in the first-third embodiments mentioned above, air blowing ports installed separately from the air blowing duct 50 can be opened/closed. For example, the openings 83 of the cover member 80 (FIG. 15) that allows cooling air pass through can be opened/closed. That is, air blowing ports installed in air blowing routes forwarding cooling air to the process units 10 can be opened/closed.

Although the embodiments and the modification example of this invention were explained above, this invention is not limited to the embodiments mentioned above, but various modifications and changes are possible.

This invention can be utilized in image forming apparatuses (such as copiers, facsimile machines, printers, and multifunction peripherals) that form an image on a medium using an electrophotographic method.

What is claimed is:

1. An image forming apparatus, comprising:

an image forming unit that forms an image in an image forming state and does not form an image in a non-image forming state, an air blowing part that blows air toward the image forming unit, an air flow rate changing part that changes a flow rate of the air, which is blown toward the image forming unit from the air blowing part, a switching part that switches between the image forming state and the non-image forming state of the image forming unit, wherein the air flow rate changing part changes the air flow rate of the air blowing part in mechanical correspondence with the switching between the image forming state and the non-image forming state of the image forming unit by the switching part, the switching part is provided with a coupling mechanism that sets the image forming unit into the image forming state by transmitting a drive force to the image forming unit, and sets the image forming unit into the non-image forming state by not transmitting the drive force to the image forming unit, the coupling mechanism is provided with a movable part that is movable between a first position and a second position, the movable part transmits the drive force to the image forming unit when being at the first position, and does not transmit the drive force to the image forming unit when being at the second position, the air blowing part is provided with an air blowing port from which the air is blown out, and the movable part is provided with a closing part that opposes the air blowing port of the air blowing part when the movable part is in the second position.

2. The image forming apparatus according to claim 1, wherein the air blowing part is provided with an air blowing port from which the air is blown out, the air blowing part is configured to open the air blowing port when the image forming unit is in the image forming state, and the air blowing part is configured to at least partially close the air blowing port when the image forming unit is in the non-image forming state.

3. The image forming apparatus according to claim 2, wherein the air flow rate changing part entirely closes the air blowing port when the image forming unit is in the non-image forming state.

4. The image forming apparatus according to claim 1, wherein the image forming unit is provided with a developer carrier that carries a developer, an image carrier that carries the image, and a drive force receiving part that is connected to either the developer carrier or the image carrier, transferring the drive force to one of the developer carrier and the image carrier, which is connected, the coupling mechanism is provided with an engagement part that engages with the drive force receiving part, and the movable part causes the engagement part to engage with the drive force receiving part, and causes the engagement part to move so as to get out of the drive force receiving part.

5. The image forming apparatus according to claim 1, wherein the movable part is a slider that moves straight in a direction perpendicular to a longitudinal direction of the image forming unit.

6. The image forming apparatus according to claim 1, wherein the image forming unit is provided with a developer carrier that carries a developer, an image carrier that carries the image, and the switching part is provided with an engagement part that engages with a drive force receiving part, and the air flow rate changing part is provided with an open/close door wherein the open/close door contacts to the engagement part and opens or at least partially closes an air blowing port of the air blowing part.

7. The image forming apparatus according to claim 6, wherein the open/close door contacts to the engagement part and closes the air blowing port when the engagement part engages with the drive force receiving part.

8. The image forming apparatus according to claim 6, further comprising:

a bias member that biases the open/close door in a direction to open the air blowing port.

9. The image forming apparatus according to claim 6, wherein the open/close door rotates centering on a prescribed rotation shaft.

10. The image forming apparatus according to claim 1, further comprising:

a transfer unit to which the image formed in the image forming unit is transferred, wherein the image forming unit is configured to move between a transfer position at which the image forming unit is in contact with the transfer unit and a separated position at which the image forming unit is separated from the transfer unit, and the switching part is provided with a separation mechanism that sets the image forming unit into the image forming state by moving the image forming unit to the transfer position, and sets the image forming unit into the non-image forming state by moving the image forming unit to the separated position.

11. The image forming apparatus according to claim 10, wherein the separation mechanism is provided with a moving body that is movable between a first position and a second position, and the moving body moves the image forming unit to the transfer position by moving to the first position, and moves the image forming unit to the separated position by moving to the second position.

12. The image forming apparatus according to claim 11, wherein the moving body is a slider that moves straight.

13. The image forming apparatus according to claim 1, wherein the air blowing part forwards air sent up along an air blowing route toward the image forming unit.

14. The image forming apparatus according to claim 1, wherein the air blowing part is in a duct shape.

15. The image forming apparatus according to claim 1, further comprising:

another image forming unit that forms an image, wherein the image forming unit is configured to form a black image, defining it as a black image unit, the another image forming unit is configured to form a non-black image, that is formed with any color other than black, defining it as a non-black image unit, the air flow rate changing part reduces the flow rate of air blown from the air blowing part to the non-black image unit while the black image unit forms the black image.

16. The image forming apparatus according to claim 15, wherein the air blowing part is provided with a plurality of air blowing ports corresponding to the black image unit and the non-black image unit, wherein the air flow rate changing part closes at least partially the air blowing ports corresponding to the non-black image unit while keeping the air blowing port corresponding to the black image unit open while the black image unit forms the black image.

17. An image forming apparatus, comprising:

an image forming unit that forms an image when a working state of the image forming unit is an image forming state and does not form an image when the working state is a non-image forming state, an air blowing part that blows air toward the image forming unit, an air flow rate changing part that changes a flow rate of the air, which is blown toward the image forming unit from the air blowing part, a switching part that performs a switching to switch the working state of the image forming unit between the image forming state and a non-image forming state, and a transfer unit to which the image formed in the image forming unit is transferred, wherein the air flow rate changing part changes the air flow rate of the air blowing part in mechanical correspondence with the switching between the image forming state and the non-image forming state of the image forming unit by the switching part, the image forming unit is configured to move between a transfer position at which the image forming unit is in contact with the transfer unit and a separated position at which the image forming unit is separated from the transfer unit, the switching part is provided with a separation mechanism that sets the image forming unit into the image forming state by moving the image forming unit to the transfer position, and sets the image forming unit into the non-image forming state by moving the image forming unit to the separated position, the separation mechanism is provided with a moving body that is movable between a first position and a second position, the moving body moves the image forming unit to the transfer position by moving to the first position, and moves the image forming unit to the separated position by moving to the second position, the air blowing part is provided with an air blowing port from which the air is blown out, and the moving body is provided with a closing part that opposes the air blowing port of the air blowing part when the moving body is in the second position.

18. An image forming apparatus, comprising:

an image forming unit that forms an image in an image forming state and does not form an image in a non-image forming state, an air blowing part that blows air toward the image forming unit, a slider that changes a flow rate of the air, which is blown toward the image forming unit from the air blowing part, and a switching part that switches between the image forming state and the non-image forming state of the image forming unit, wherein the slider changes the air flow rate of the air blowing part in mechanical correspondence with a switching between the image forming state and the non-image forming state of the image forming unit by the switching part, the slider reciprocates between a first position and a second position, shifting to the first position when the switching part switches the image forming unit to the image forming state, and shifting to the second position when the switching part switches the image forming unit to the non-image forming state, the air blowing part is provided with an air blowing port from which the air is blown out, and the slider is provided with a closing part that opposes the air blowing port when the slider is in the second position.

* * * * *